US008791628B2

(12) United States Patent
Fukai et al.

(10) Patent No.: US 8,791,628 B2
(45) Date of Patent: Jul. 29, 2014

(54) LIGHT EMITTING APPARATUS, VEHICLE HEADLAMP, ILLUMINATING APPARATUS, AND VEHICLE, AND METHOD FOR ASSEMBLING THE LIGHT EMITTING APPARATUS

(75) Inventors: Yasuo Fukai, Osaka (JP); Kei Yamamoto, Osaka (JP); Koji Takahashi, Osaka (JP); Yoshiyuki Takahira, Osaka (JP); Yosuke Maemura, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 337 days.

(21) Appl. No.: 13/276,876

(22) Filed: Oct. 19, 2011

(65) Prior Publication Data

US 2012/0104934 A1 May 3, 2012

(30) Foreign Application Priority Data

Oct. 29, 2010 (JP) ..... 2010-244575

(51) Int. Cl.
*H01J 1/62* (2006.01)
*F21S 8/10* (2006.01)

(52) U.S. Cl.
CPC ..... *F21S 48/1145* (2013.01)
USPC ..... 313/498; 445/23

(58) Field of Classification Search
CPC ..... H01J 1/70; F21S 48/1145; F21S 48/119; F21S 48/12; F21S 48/13; F21S 48/1358; F21Y 2101/025
USPC ..... 445/23; 313/488, 498
See application file for complete search history.

(56) References Cited

U.S. PATENT DOCUMENTS

| | | | | |
|---|---|---|---|---|
| 3,586,851 | A * | 6/1971 | Rudolph | 362/293 |
| 2005/0105301 | A1 | 5/2005 | Takeda et al. | |
| 2005/0270775 | A1* | 12/2005 | Harbers et al. | 362/231 |
| 2008/0116473 | A1 | 5/2008 | Sugiyama | |
| 2011/0292636 | A1* | 12/2011 | Fukai et al. | 362/19 |

FOREIGN PATENT DOCUMENTS

| | | |
|---|---|---|
| JP | 2000-275444 | 10/2000 |
| JP | 2005-150041 | 6/2005 |
| JP | 2008-153617 | 7/2008 |
| JP | 2009-266437 | 11/2009 |

* cited by examiner

*Primary Examiner* — Andrew Coughlin
(74) *Attorney, Agent, or Firm* — Morrison & Foerster LLP

(57) ABSTRACT

A light emitting apparatus includes: a laser element which emits laser light; a light emitting section which generates fluorescence in response to the laser light emitted from the laser element; a parabolic mirror which reflects the fluorescence generated by the light emitting section; and a multilayer filter which transmits the laser light and reflects the fluorescence, the laser element being provided outside the parabolic mirror, the parabolic mirror being provided with a window part through which the laser light passes, and the multilayer filter being provided so as to cover the window part.

18 Claims, 13 Drawing Sheets

LASER ELEMENT SIDE

| | THICKNESS [nm] |
|---|---|
| $TiO_2$ | 59 |
| $SiO_2$ | 94 |
| $TiO_2$ | 55 |
| $SiO_2$ | 88 |
| $TiO_2$ | 55 |
| $SiO_2$ | 88 |
| $TiO_2$ | 55 |
| $SiO_2$ | 88 |
| $TiO_2$ | 68 |
| $SiO_2$ | 127 |
| $TiO_2$ | 69 |
| $SiO_2$ | 110 |
| $TiO_2$ | 69 |
| $SiO_2$ | 112 |
| $TiO_2$ | 82 |

LIGHT EMITTING SECTION SIDE

LIGHT EMITTING APPARATUS, VEHICLE HEADLAMP, ILLUMINATING APPARATUS, AND VEHICLE, AND METHOD FOR ASSEMBLING THE LIGHT EMITTING APPARATUS

This Nonprovisional application claims priority under 35 U.S.C. §119(a) on Patent Application No. 2010-244575 filed in Japan on Oct. 29, 2010, the entire contents of which are hereby incorporated by reference.

TECHNICAL FIELD

The present invention relates to a light emitting apparatus which uses, as illumination light, fluorescence generated by irradiating a fluorescent material with excitation light, a vehicle headlamp, an illuminating apparatus, and a vehicle including the vehicle headlamp, and a method for assembling the light emitting apparatus.

BACKGROUND ART

A light emitting apparatus has recently been actively researched in which a semiconductor light emitting element such as a light emitting diode (LED) or a semiconductor laser diode (LD) is used as an excitation light source and fluorescence generated by irradiating a light emitting section containing a fluorescent material with excitation light generated from such an excitation light source is used as illumination light.

Such a light emitting apparatus is exemplified by a light source unit disclosed in Patent Literature 1. The light source unit irradiates a fluorescent material with light emitted from a light source section and the irradiation causes the fluorescent material to generate diffused light. A reflecting mirror, which is provided between the light source section and the fluorescent material, carries out light distribution control with respect to the diffused light from the fluorescent material so as to cause the diffused light to be substantially parallel and to be emitted forward.

As described earlier, according to the light source unit, the reflecting mirror is provided between the light source section and the fluorescent material. Therefore, the reflecting mirror has a light transmitting section which is a hole via which light is transmitted from the light source section toward the fluorescent material. The light emitted from the light source section enters the reflecting mirror from the light source section side, is transmitted through the light transmitting section, and goes toward the fluorescent material.

The light transmitting section which transmits the light emitted from the light source section is merely a hole which is through the reflecting mirror. Therefore, of the diffused light generated by the fluorescent material, light going to the light transmitting section is transmitted through the light transmitting section which is the opening. Namely, a part of the diffused light enters the reflecting mirror from the fluorescent material side, is transmitted through the light transmitting section, and goes toward the light source section. Namely, the part of the diffused light leaks out of the light transmitting section. Therefore, the light source unit raises a problem of causing a decrease in efficiency with which the diffused light generated by the fluorescent material is used.

In view of such a problem, it can be said that it is preferable to provide the light transmitting section with a wavelength-selective reflecting mirror or band-pass filter which transmits the light emitted from the light source section but does not transmit the diffused light generated by the fluorescent material, i.e., reflects the diffused light.

For example, according to a light emitting apparatus disclosed in Patent Literature 2, an emission end face of a fiber optical waveguide is provided with a reflecting mirror which has a high reflectance with respect to a wavelength of semiconductor laser light and has a low reflectance with respect to a wavelength of emission by the fluorescent material. Such a reflecting mirror transmits light generated by the fluorescent material but reflects the semiconductor laser light on the emission end face of the fiber optical waveguide.

According to a semiconductor light emitting apparatus disclosed in Patent Literature 3, a cylindrical cap surrounds a semiconductor light emitting element, and a wavelength conversion substance (a fluorescent material) is provided outside the cap. Light emitted from the semiconductor light emitting element goes through a through-hole opened in a main part of the cap, and the wavelength conversion substance provided outside the cap is irradiated with the light. The through-hole is provided with a light selecting filter. As such a light selecting filter, a wavelength-selective band-pass filter is used which transmits the light emitted from the semiconductor light emitting element but does not transmit light having been subjected to wavelength conversion by use of the wavelength conversion substance.

In order to prevent a leak of the diffused light from the light transmitting section in the light source unit of Patent Literature 1, it can be expected to be effective to provide the light transmitting section with the reflecting mirror of Patent Literature 2 or the band-pass filter of Patent Literature 3. It is only necessary that wavelength selectivity of the reflecting mirror or the band-pass filter be controlled to transmit the light emitted from the light source and reflect the diffused light from the light emitting section.

Normally, it is common to use, as the reflecting mirror of Patent Literature 2 or the band-pass filter of Patent Literature 3, not a single layer film but a multilayer film which is constituted by a plurality of layers of films. According to such a multilayer film, in a case where kinds of films of respective layers and optical path lengths in the respective layers are combined most suitably, desired wavelength selectivity can be obtained.

Note that an optical path length is obtained by multiplying a distance which light has actually traveled in each layer (hereinafter may be referred to as a "propagation distance") by a refractive index of a substance constituting a film in the each layer. Namely, the optical path length is defined by the following equation:

$$\text{Optical path length} = \text{propagation distance} \times \text{refractive index}$$

CITATION LIST

Patent Literature 1

Japanese Patent Application Publication, Tokukai, No. 2005-150041 A (Publication Date: Jun. 9, 2005)

Patent Literature 2

Japanese Patent Application Publication, Tokukai, No. 2000-275444 A (Publication Date: Oct. 6, 2000)

Patent Literature 3

Japanese Patent Application Publication, Tokukai, No. 2008-153617 A (Publication Date: Jul. 3, 2008)

SUMMARY OF INVENTION

Technical Problem

The multilayer film described above is particularly required to control the optical path lengths in the respective layers with high accuracy so as to realize its wavelength selectivity. This is because a combination of the optical path lengths in the respective layers serves as a cause of a great influence on the wavelength selectivity of the multilayer film. Thicknesses of the respective layers of the multilayer film are determined so that required optical path lengths can be obtained in the respective layers. Note that the thicknesses of the respective layers, i.e., propagation distances which light travels in the respective layers can be found from the required optical path lengths based on the above equation.

Note here that according to the light emitting apparatus of Patent Literature 2, the fluorescent material and the reflecting mirror are spatially close to each other. Since the fluorescent material generates light radially centering on itself, light going in various directions enters the reflecting mirror which is close to the fluorescent material.

As in the case of the light emitting apparatus of Patent Literature 2, according to the semiconductor light emitting apparatus of Patent Literature 3, the wavelength conversion substance and the band-pass filter are spatially close to each other. Since the wavelength conversion substance causes light to be generated radially, light going in various directions also enters the band-pass filter.

The entrance of such light going in various directions into the multilayer film means that optical path lengths of the light traveling in the respective layers are also varied. However, the optical path lengths in the respective layers are determined assuming that light enters the multilayer film in a given direction. Then, the given direction in which the light enters the multilayer film is used to determine the thicknesses of the respective layers so that required optical path lengths can be obtained in the respective layers.

Therefore, for light which deviates from the assumed given direction, its optical path lengths of the respective layers of the multilayer film are not most suitable. This prevents the multilayer film from realizing desired wavelength selectivity.

If an identical optical pass length is to be set with respect to all light entering the multilayer film in various directions, each of the layers of the multilayer film needs to be molded to be complicatedly shaped, which is impractical.

As described earlier, even in a case where the light transmitting section is merely provided with the reflecting mirror of Patent Literature 2 or the band-pass filter of Patent Literature 3 in the light source unit of Patent Literature 1, it is difficult to cause the reflecting mirror or the band-pass filter to realize desired wavelength selectivity. This causes a problem such that it is impossible to securely prevent diffused light generated by the light emitting section from leaking from the light transmitting section.

In view of the problems, an object of the present invention is to provide a light emitting apparatus which is capable of enhancing efficiency with which fluorescence generated by a fluorescent material is used, a vehicle headlamp, an illuminating apparatus, and a vehicle including the vehicle headlamp, and a method for assembling the light emitting apparatus.

Solution to Problem

In order to attain the object, a light emitting apparatus in accordance with the present invention includes: an excitation light source which emits excitation light; a light emitting section which generates fluorescence in response to the excitation light emitted from the excitation light source; a reflecting mirror which reflects the fluorescence generated by the light emitting section; and an optical functional member which transmits the excitation light and reflects the fluorescence, the excitation light source being provided outside the reflecting mirror, the reflecting mirror being provided with a light passage opening through which the excitation light passes, and the optical functional member being provided so as to cover the light passage opening.

According to the arrangement, the light emitting section generates fluorescence in response to the excitation light emitted from the excitation light source and the reflecting mirror reflects the fluorescence, so that the fluorescence is emitted as illumination light. The excitation light source is provided outside the reflecting mirror. The excitation light emitted from the excitation light source passes through the light passage opening which is provided in the reflecting mirror, so as to be directed to the light emitting section.

Note here that the light emitting section which is irradiated with the excitation light generates the fluorescence radially centering on itself. Therefore, a part of the fluorescence generated by the light emitting section goes toward the light passage opening through which the excitation light passes.

In this case, if the fluorescence going toward the light passage opening of the reflecting mirror passes straight through the light passage opening, the fluorescence leaks to the outside of the reflecting mirror. The fluorescence thus having leaked cannot be used as the illumination light of the light emitting apparatus.

This means a reduction in efficiency with which the fluorescence is used and consequently a reduction in brightness of the illumination light of the light emitting apparatus.

In view of the circumstances, according to the arrangement, the optical functional member is used to cover the light passage opening of the reflecting mirror. The optical functional member transmits the excitation light emitted from the excitation light source and reflects the fluorescence generated by the light emitting section.

Further, according to the arrangement, the optical functional member, which is provided at the light passage opening of the reflecting mirror, is spatially away from the light emitting section. Therefore, the fluorescence can be considered to enter the optical functional member substantially unidirectionally.

Therefore, since it is possible to prevent the fluorescence from leaking to the outside of the reflecting mirror from the light emitting section side, it is possible to enhance efficiency with which the fluorescence generated by the light emitting section is used.

A method in accordance with the present invention for assembling a light emitting apparatus, the light emitting apparatus including: an excitation light source which emits excitation light; a light emitting section which generates fluorescence in response to the excitation light emitted from the excitation light source; a reflecting mirror which reflects the fluorescence generated by the light emitting section; and an optical functional member which transmits the excitation light and reflects the fluorescence, the excitation light source being provided outside the reflecting mirror, the reflecting mirror being provided with a light passage opening through which the excitation light passes, and the optical functional member being provided so as to cover the light passage opening, the method comprising the step of: positioning the excitation light source so that the excitation light passes through a center of the light passage opening.

For example, the excitation light source is positioned while the light emitting apparatus is being assembled. During the positioning, an emission angle at which the excitation light source emits the excitation light with respect to the light passage opening is determined so that the excitation light emitted from the excitation light source passes through the light passage opening without fail.

However, the emission angle of the excitation light source may deviate as time passes. When the deviation becomes great, an optical path of the excitation light deviates from the light passage opening, so that the excitation light cannot pass through the light passage opening. Accordingly, it can be said that a larger allowable value for the deviation of the emission angle is preferable.

In view of the circumstances, according to the arrangement, the excitation light source is located with respect to the light passage opening so that the excitation light passes through a center of the light passage opening. In this case, if the emission angle of the excitation light source starts deviating, the optical path of the excitation light starts deviating from the center of the light passage opening. This means that it is possible to maximize a scale of the deviation of the emission angle which scale is necessary for the optical path of the excitation light to deviate from the light passage opening.

Therefore, according to the arrangement, it is possible to maximize an allowable value for the emission angle of the excitation light source.

Advantageous Effects of Invention

As described earlier, in order to attain the object, a light emitting apparatus in accordance with the present invention includes: an excitation light source which emits excitation light; a light emitting section which generates fluorescence in response to the excitation light emitted from the excitation light source; a reflecting mirror which reflects the fluorescence generated by the light emitting section; and an optical functional member which transmits the excitation light and reflects the fluorescence, the excitation light source being provided outside the reflecting mirror, the reflecting mirror being provided with a light passage opening through which the excitation light passes, and the optical functional member being provided so as to cover the light passage opening.

This yields an effect of enhancing efficiency with which fluorescence generated by a fluorescent material is used.

BRIEF DESCRIPTION OF DRAWINGS

FIG. 2(*b*), which schematically illustrates the shape and the location of the multilayer filter, is a schematic plane view of the multilayer filter, the parabolic mirror, and the light emitting section.

FIG. 7(*b*), which illustrates the location of the laser element with respect to the window part, is a schematic view corresponding to a case where the laser light passes through a place in the window part which place deviates from the center of the window part.

FIG. 15(*b*) illustrates a method for preparing the multilayer filter.

FIG. 18(*b*) illustrates a method for assembling a headlamp of the present invention.

FIG. 18(*c*) illustrates a method for assembling a headlamp of the present invention.

FIG. 18(*d*) illustrates a method for assembling a headlamp of the present invention.

DESCRIPTION OF EMBODIMENTS

Figure 1:
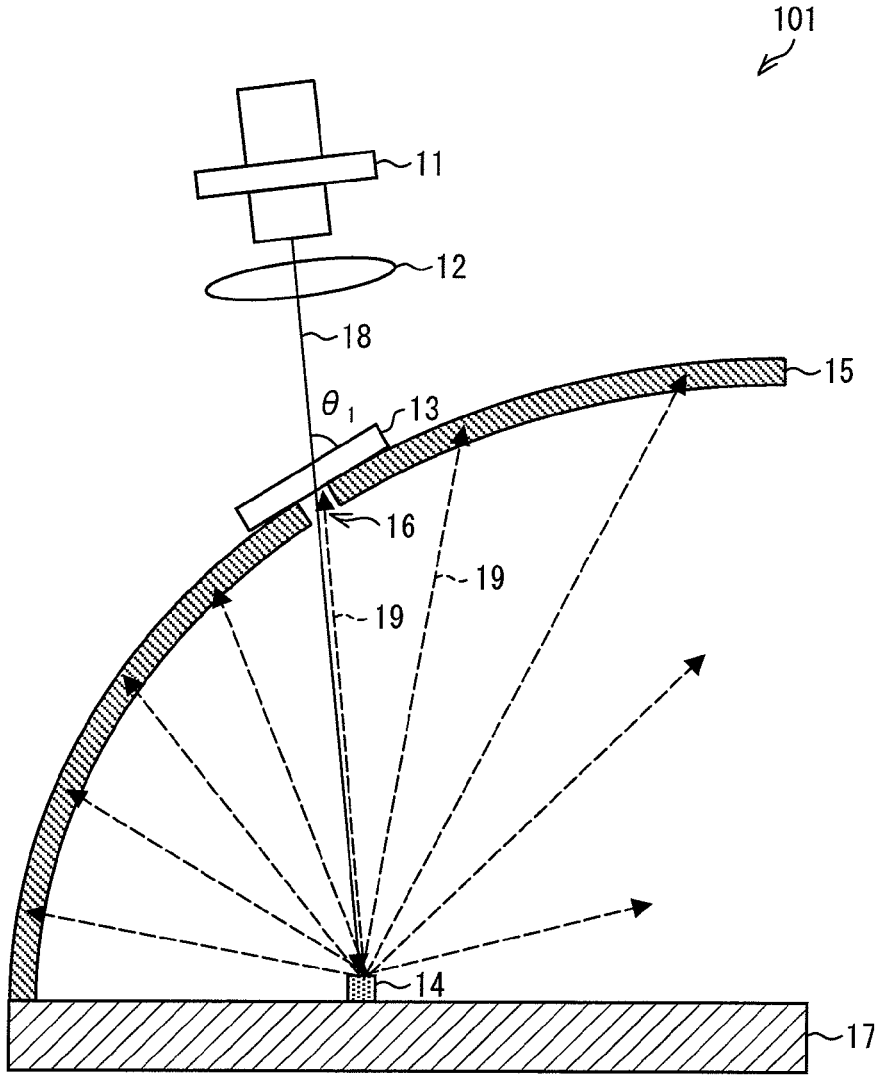
FIG. 1 is a cross-sectional view schematically illustrating an arrangement of a headlamp in accordance with a first embodiment of the present invention.

Embodiments of the present invention are described below with reference to drawings. Identical parts are given respective identical reference numerals in the drawings. However, it should be noted that, since the drawings are schematic views, members are different from actual members in terms of a relationship between a section size and a plane size, a ratio between section sizes of the respective members, a ratio between plane sizes of the respective members, and the like. Further, it is a matter of course that some parts are different among the drawings in terms of a relationship and a ratio between sizes of the respective parts.

First Embodiment

A first embodiment of the present invention is described below with reference to FIGS. 1 through 9.

<Arrangement of Headlamp 101>

FIG. 1 is a cross-sectional view schematically illustrating an arrangement of a headlamp 101 in accordance with the first embodiment of the present invention. The headlamp 101 includes a laser element (an excitation light source) 11, a lens 12, a multilayer filter (an optical functional member) 13, a light emitting section 14, a parabolic mirror (a reflecting mirror) 15, and a metal base 17 (see FIG. 1).

(Laser Element 11)

The laser element 11 is a light emitting element which functions as an excitation light source that emits excitation light. A plurality of laser elements 11 may be provided. In this case, laser light as excitation light oscillates from each of the plurality of laser elements 11. Though only one laser element 11 may be used, use of a plurality of laser elements 11 makes it easier to obtain high-power laser light. In a case where a plurality of laser elements 11 are used, all laser light emitted from each of the plurality of laser elements 11 passes through a window part 16 of the parabolic mirror 15 (described later), so as to be directed to the light emitting section 14.

A laser element 11 may have one light emitting point for each chip or may have a plurality of light emitting points for each chip. Laser light emitted from the laser element 11 has a wavelength of, for example, 405 nm (violet) or 450 nm (blue). However, laser light is not limited to this and may be appropriately selected in accordance with a kind of fluorescent material to be contained in the light emitting section 14. Note that a light emitting diode (LED) can be used as the excitation light source (light emitting element) instead of the laser element 11.

(Lens 12)

The lens 12 adjusts (e.g., reduces) a range of irradiation of the laser light so as to cause the light emitting section 14 to be suitably irradiated with the laser light emitted from the laser element 11.

The range of irradiation of the laser light may be adjusted by not only such an adjustment by the lens 12 but also an adjustment of a location and/or a size of the light emitting section 14 (described later). Of course, the adjustment by the lens 12 and the adjustment of the location and/or the size of the light emitting section 14 may be used in combination to adjust the range of irradiation of the laser light.

(Light Emitting Section 14)

The light emitting section 14, which generates fluorescence in response to the laser light emitted from the laser element 11, contains a fluorescent material which emits light in response to laser light. Specifically, the light emitting section 14 is obtained by dispersing a fluorescent material in an inside of a sealing member or solidifying the fluorescent material. It can be said that the light emitting section 14, which converts laser light to fluorescence, is a wavelength conversion element.

The light emitting section 14 is provided on the metal base 17 and substantially at a focal point of the parabolic mirror 15. Therefore, in a case where the fluorescence emitted from the light emitting section 14 is reflected by a reflection curved surface of the parabolic mirror 15, an optical path of the fluorescence is controlled. An upper surface of the light emitting section 14 may have an antireflection structure which prevents reflection of laser light.

For example, an oxynitriding fluorescent material (e.g., a sialon fluorescent material) or a III-V group compound semiconductor nanoparticle fluorescent material (e.g., indium phosphide: InP) can be used as the fluorescent material of the light emitting section 14. Such a fluorescent material, which is highly thermotolerant to the laser light emitted from the laser element 11 and having high power (and/or light density), is suitable for a laser illuminating light source. However, the fluorescent material of the light emitting section 14 is not limited to the above fluorescent materials and another fluorescent material such as a nitride fluorescent material may be used.

Note that it is prescribed by law that illumination light of a headlamp should be white light which has chromaticity falling within a given range. Therefore, the light emitting section 14 contains a fluorescent material which has been selected so that illumination light is white.

For example, the light emitting section 14 containing blue, green, and red florescent materials generates white light when irradiated with laser light having a wavelength of 405 nm. Alternatively, the light emitting section 14 containing a yellow fluorescent material (or the green and red fluorescent materials) generates white light when irradiated with laser light having a wavelength of 450 nm (blue) (or so-called laser light in a vicinity of blue having a peak wavelength falling within a range of not less than 440 nm and not more than 490 nm).

A sealing material for the light emitting section 14 is exemplified by glass materials (inorganic glass and organic-inorganic hybrid glass) and resin materials such as silicone resin. Low melting glass may be used as a glass material. A highly transparent sealing material is preferable, and a highly heat-resistant sealing material is preferable in a case where laser light has high power.

(Parabolic Mirror 15)

The parabolic mirror 15 reflects the fluorescence generated by the light emitting section 14 and forms a bundle of rays (illumination light) which travels in a given solid angle. The parabolic mirror 15 may be a member having a surface on which a metal thin film is provided or may be a metal member.

A part of the parabolic mirror 15 is located above the upper surface of the light emitting section 14. Namely, the parabolic mirror 15 is provided so as to cover the upper surface of the light emitting section 14. From another viewpoint, a part of a side surface of the light emitting section 14 is directed toward an opening of the parabolic mirror 15.

In a case where the light emitting section 14 and the parabolic mirror 15 have a positional relationship as described earlier, it is possible to enhance efficiency with which the fluorescence generated by the light emitting section 14 is collected in the given solid angle. This can enhance efficiency with which the fluorescence is used.

The laser element 11 is provided outside the parabolic mirror 15. The parabolic mirror 15 has the window part (light passage opening) which transmits laser light. The window part 16 is a through-hole between an outside (the laser element 11 side) and an inside (the light emitting section 14 side) of the parabolic mirror 15.

The multilayer filter 13 is provided to cover the window part 16 (described later). The laser light emitted from the laser element 11 is transmitted through the multilayer filter 13 and then passes through the window part 16.

Note that the parabolic mirror 15 may partially have a part which is not parabolic. A reflecting mirror provided in a light emitting apparatus of the present invention may include a parabolic mirror having a closed circular opening or a part of the parabolic mirror. The reflecting mirror is not limited to a parabolic mirror and may be an ellipsoidal mirror or a hemispherical mirror.

(Metal Base 17)

The metal base 17, which is a plate supporting member that supports the light emitting section 14, is made of metal (e.g., copper or iron). Therefore, the metal base 17 is highly thermally conductive and is capable of cooling the light emitting section 14. Note that a member which supports the light emitting section 14 need not be made of metal. The member may contain a highly thermally conductive substance (such as glass or sapphire) other than metal. However, it is preferable that a surface of the metal base 17 which surface is partially in contact with the light emitting section 14 function as a reflecting surface. In a case where the surface is a reflecting surface, the laser light having entered the light emitting section 14 from the upper surface of the light emitting section 14 is converted to fluorescence and then reflected by the reflecting surface, so that the fluorescence thus reflected can go to the parabolic mirror 15. Alternatively, the laser light having entered the light emitting section 14 from the upper surface of the light emitting section 14 is reflected by the reflecting surface, so that the laser light thus reflected can go to an inside of the light emitting section 14 again to be converted to fluorescence.

It can be said that, since the metal base 17 is covered with the parabolic mirror 15, the metal base 17 has a surface which faces the reflection curved surface of the parabolic mirror 15. The surface of the metal base 17 on which surface the light emitting section 14 is provided is substantially parallel to a rotation axis of a paraboloid of the parabolic mirror 15 and substantially contains the rotation axis.

Note that the metal base 17 may include a fin (not illustrated). The fin functions as a cooling section which cools the metal base 17. The fin, which has a plurality of radiator plates, enhances radiation efficiency by increasing an area of contact with atmosphere. It is only necessary that the cooling section which cools the metal base 17 have a cooling (radiating) function. A heat pipe, a water-cooling system, or an air-cooling system may be used instead of the fin.

(Multilayer Filter 13)

The multilayer filter 13 is provided on the parabolic mirror 15 so as to cover the window part 16 of the parabolic mirror 15. The multilayer filter 13 transmits laser light (excitation light) 18 emitted from the laser element 11 and also reflects fluorescence 19 emitted from the light emitting section 14. Namely, the multilayer filter 13 has wavelength selectivity such that the multilayer filter 13 transmits light including the laser light 18 and having a wavelength falling within a given range and reflects light including the fluorescence 19 and having a wavelength falling within a given range. The multilayer filter 13 transmits the laser light 18 emitted from the laser element 11 due to such wavelength selectivity. The laser light 18 having been transmitted through the multilayer filter 13 passes straight through the window part 16 and then goes to an inside of the parabolic mirror 15. The laser light 18 having entered the inside of the parabolic mirror 15 is thus directed to the light emitting section 14.

In contrast, due to the wavelength selectivity, the multilayer filter 13 reflects the fluorescence 19 having been emitted from the light emitting section 14 and then entered the window part 16. The fluorescence 19 reflected by the multilayer filter 13 goes to the inside of the parabolic mirror 15 again. In a case where there exists no multilayer filter 13, the fluorescence 19 going to the window part 16 passes straight through the window part 16 and then leaks to the outside of the parabolic mirror 15. The multilayer filter 13 causes the fluorescence 19 to go to the inside of the parabolic mirror 15 again, so as to enhance efficiency with which the light emitting section 14 uses the fluorescence 19.

<Entrance of Laser Light 18>

It is preferable that the laser light 18 emitted from the laser element 11 be P polarized light with respect to an entrance surface of the multilayer filter 13 from which surface the laser light 18 enters the multilayer filter 13 and an entrance angle $\theta_1$ with respect to the entrance surface of the multilayer filter 13 from which surface the laser light 18 enters the multilayer filter 13 be a Brewster angle. Use of such an entrance method of the laser light 18 can prevent reflection of the laser light 18 when the laser light 18 enters the multilayer filter 13 from the entrance surface of the multilayer filter 13 from which surface the laser light 18 enters the multilayer filter 13, so as to enhance efficiency with which the laser light 18 enters the multilayer filter 13.

Note that it is only necessary to locate the laser element 11 with respect to the multilayer filter 13 so that the laser light 18 is P polarized light with respect to the entrance surface of the multilayer filter 13 from which surface the laser light 18 enters the multilayer filter 13 and the entrance angle $\theta_1$ is a Brewster angle.

<Distance between the Light Emitting Section 14 and Window Part 16 and Aperture Area of the Window Part 16>

The light emitting section 14 is provided substantially at the focal point of the parabolic mirror 15 (described earlier). In view of such an arrangement, a distance between the light emitting section 14 and the window part 16 of the parabolic mirror 15 depends on a shape and a size of the parabolic mirror 15.

The window part 16 is a hole through which the laser light 18 emitted from the laser element 11 merely passes. An aperture area of the window part 16 can be sufficiently smaller than the distance between the light emitting section 14 and the window part 16 of the parabolic mirror 15 though depending on accuracy of an optical axis of the laser light 18.

Note here that, in a case where the distance between the light emitting section 14 and the window part 16 is sufficiently larger than the aperture area of the window part 16, the window part 16 can be considered as substantially one point of the parabolic mirror 15 when seen from the light emitting section 14. In this case, the fluorescence 19 emitted radially from the light emitting section 14 can be considered to enter the window part 16 in a substantially identical direction. For example, in a case where the window part 16 has an aperture having a circular shape and the distance between the light emitting section 14 and the window part 16 is sufficiently larger than a radius (or a diameter) of the circular shape, the fluorescence 19 can be considered to enter the window part 16 in a substantially identical direction.

The multilayer filter 13 has a multilayer film of a plurality of layers of films (described later). In order to realize wavelength selectivity of the multilayer film, optical path lengths of light traveling in the respective plurality of layers need to be controlled with high accuracy. In this case, if the fluorescence 19 can be considered to enter the window part 16 in a substantially identical direction, the optical path lengths in the respective plurality of layers of the multilayer film can be controlled by use of the substantially identical direction. This facilitates control of the optical path lengths, so that the optical path lengths are controlled with higher accuracy.

Note that it goes without saying that, as the distance between the light emitting section 14 and the window part 16 is larger than the aperture area of the window part 16, the fluorescence 19 enters the window part 16 in a more single direction. However, since the distance between the light emitting section 14 and the window part 16 depends on the shape and the size of the parabolic mirror 15 (described earlier), it is necessary to consider that the aperture area of the window part 16 depends on accuracy of an optical axis of the laser element 11.

<Shape and Location of the Multilayer Filter 13>

Figure 2:
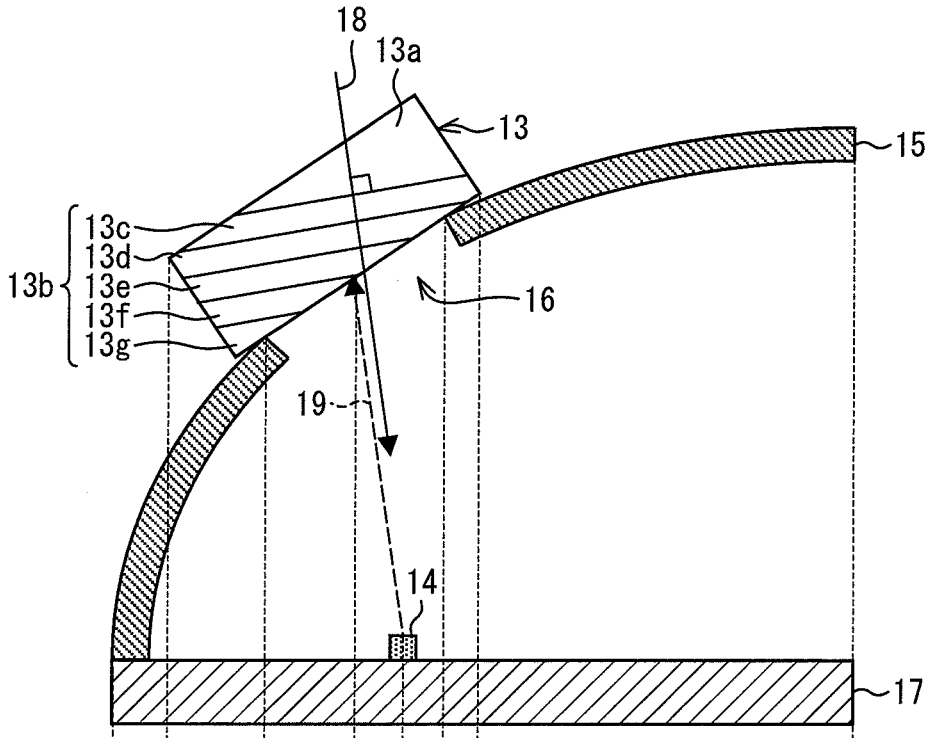
FIG. 2(*a*), which schematically illustrates a shape and a location of a multilayer filter, is a schematic cross-sectional view of the multilayer filter, a parabolic mirror, and a light emitting section.
Figure 2:
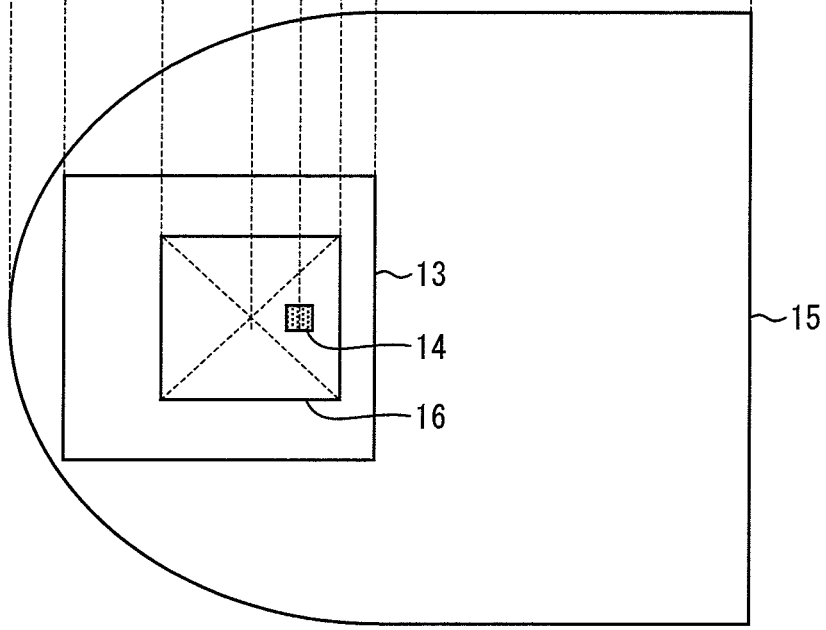

Each of FIG. 2(*a*) and FIG. 2(*b*) illustrates a shape and a location of the multilayer filter 13. FIG. 2(*a*) is a schematic cross-sectional view of the multilayer filter 13, the parabolic mirror 15, and the light emitting section 14, and FIG. 2(*b*) is a schematic plane view of the multilayer filter 13, the parabolic mirror 15, and the light emitting section 14.

The multilayer filter 13 has a supporting substrate 13*a* and a multilayer film (layer stack) 13*b* (see FIG. 2(*a*)).

The supporting substrate 13*a* supports the multilayer film 13*b* of a plurality of layers. For example, an $SiO_2$ substrate can be used as the supporting substrate 13*a*. Not to mention, the supporting substrate 13*a* need not be the $SiO_2$ substrate. Namely, the supporting substrate 13*a* may be made of any material provided that the supporting substrate 13*a* transmits the laser light 18 emitted from the laser element 18 and supports the multilayer film 13*b* so as to prevent deformation and/or breakage in the multilayer film 13*b* due to a low strength of the multilayer film 13*b*.

For example, the multilayer film 13*b* is obtained by multilayering a plurality of thin films including an $SiO_2$ film and a $TiO_2$ film. The multilayer filter 13 has wavelength selectivity such that the multilayer filter 13 transmits light including the laser light 18 and having a wavelength falling within a given range and reflects light including the fluorescence 19 and having a wavelength falling within a given range (described earlier). The multilayer film 13*b* is provided to realize such wavelength selectivity. For example, the multilayer film 13*b* is obtained by alternately stacking, in layers, a material which has a high refractive index and a material which has a low refractive index. The multilayer film 13*b* is made of at least one kind selected from AlN, $SiO_2$, SiN, $ZrO_2$, $TiO_2$, $Al_2O_3$, GaN, ZnS, and the like.

Specifically, the multilayer film 13*b* is obtained by stacking, on the supporting substrate 13*a*, a first layer film 13*c*, a second layer film 13*d*, a third layer film 13*e*, a fourth layer film 13*f*, and a fifth layer film 13*g* in this order (see FIG. 2(*a*)). Not to mention, the number of layers of the multilayer film 13*b* need not be five. In order to obtain desired wavelength selectivity, the number of the layers is determined and a kind and a thickness of each of the layers are combined most suitably.

The multilayer film 13*b*, which is obtained by multilayering a plurality of films, is normally extremely low in strength. Therefore, in a case where the multilayer film 13*b* alone is to be provided on the window part 16 of the parabolic mirror 15, deformation and/or breakage may occur in the multilayer film 13*b* due to a low strength of the multilayer film 13*b*. Alternatively, it also seems that such deformation and/or breakage may occur while the headlamp 101 is being used.

The supporting substrate 13*a* supports the multilayer film 13*b* which is low in strength as described above. The multilayer film 13*b* which is supported by the supporting substrate 13*a* has a higher strength than the multilayer film 13*b* which is used alone. This prevents deformation and/or breakage in the multilayer film 13*b*.

It is preferable to provide the multilayer filter 13 so that the multilayer film 13*b* faces the light emitting section 14. The following description discusses a reason for this.

Figure 3:
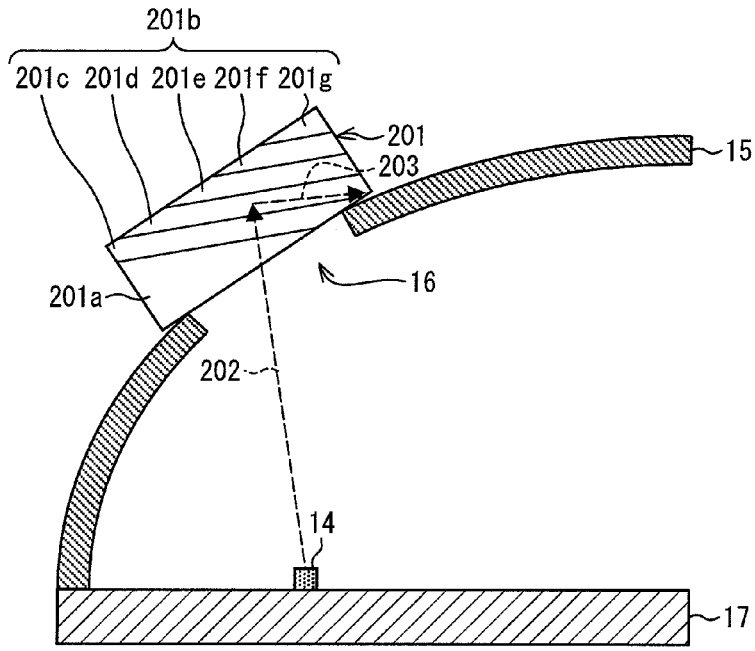
FIG. 3 illustrates an effect of a multilayer filter.

Assume that a multilayer filter 201 which is provided with a multilayer film 201*b* obtained by stacking a first layer film 201*c*, a second layer film 201*d*, a third layer film 201*e*, a fourth layer film 201*f*, and a fifth layer film 201*g* in this order is provided on a supporting substrate 201*a* so that the supporting substrate 201*a* faces the light emitting section 14 (see FIG. 3).

In this case, fluorescence 202 having been emitted from the light emitting section 14 and then entered the window part 16 enters the supporting substrate 201*a* first. Since the multilayer film 201*b* reflects the fluorescence 202, the supporting substrate 201*a* causes the fluorescence 202 to pass therethrough (described earlier). This causes the fluorescence 202 to travel in the supporting substrate 201*a* and go straight until the fluorescence 202 enters the multilayer film 201*b* (see FIG. 3). The fluorescence 202 which has passed through the supporting substrate 201*a* and then entered the multilayer film 201*b* is reflected by any of the first layer film 201*c*, the second layer film 201*d*, the third layer film 201*e*, the fourth layer film 201*f*, and the fifth layer film 201*g*. However, for example, fluorescence such as fluorescence 203 may leak to the outside of the parabolic mirror 15 depending on where the reflection occurs.

This is because the fluorescence 202 has gone out to the outside of the parabolic mirror 15 before the fluorescence 202 finishes passing through the supporting substrate 201*a*. In this case, the fluorescence 203 reflected by the multilayer film 201*b* cannot go to the inside of the parabolic mirror 15 again.

In view of this, as described earlier, it can be said that it is preferable to provide the multilayer filter 13 so that the multilayer film 13*b* faces the light emitting section 14.

The optical lengths in the respective layers of the multilayer film 13*b* are controlled to realize the wavelength selectivity. An optical path length is obtained by multiplying a distance (a propagation distance) which light has actually traveled in each layer by a refractive index of a substance constituting a film in the each layer (Optical path length=propagation distance×refractive index) (see Background Art). Note here that the propagation distance traveled in the each layer coincides with a thickness of the each layer. Accordingly, it is only necessary to control thicknesses of the respective layers assuming that a propagation distance coincides with a thickness.

Note here that the reason why propagation distances traveled in the respective layers coincide with thicknesses of the respective layers is that an optical path direction of the fluorescence 19 emitted from the light emitting section 14 and a stacking direction of the multilayer film 13*b* in which direction the layer films of the multilayer film 13*b* are stacked as described earlier coincide with each other. In other words, the reason is that the fluorescence 19 enters the respective layers of the multilayer film 13*b* in a vertical direction. This causes the propagation distances traveled by the fluorescence 19 in the respective layers and the thicknesses of the respective layers to coincide with each other. According to this, control of the thicknesses of the respective layers substantially controls the propagation distances traveled by the fluorescence 19 in the respective layers.

Note that, in a case where the laser element 11 and the light emitting section 14 face each other so that the window part 16 is sandwiched therebetween, it is only necessary that a straight line defined by the laser element 11 and the light emitting section 14 coincide with the stacking direction of the multilayer film 13*b*.

The multilayer film 13*b* is provided on the parabolic mirror 15 so as to cover the window part 16 (see FIG. 2(*b*)). Each of the laser light 18 having been emitted from the laser element 11 and the fluorescence 19 having been emitted from the light emitting section 14 and then entering the window part 16 passes through a center of the window part 16. Each of the laser element 11 and the light emitting section 14 is located with respect to the window part 16 so that each of the laser light 18 and the fluorescence 19 passes through the center of the window part 16.

Note that, in a case where the laser element 11 and the light emitting section 14 face each other so that the window part 16 is sandwiched therebetween, it is only necessary that the straight line defined by the laser element 11 and the light emitting section 14 pass through the center of the window part 16.

<Preparation of the Multilayer Filter 13>

The multilayer filter 13 is prepared by, for example, the following method.

Figure 4:
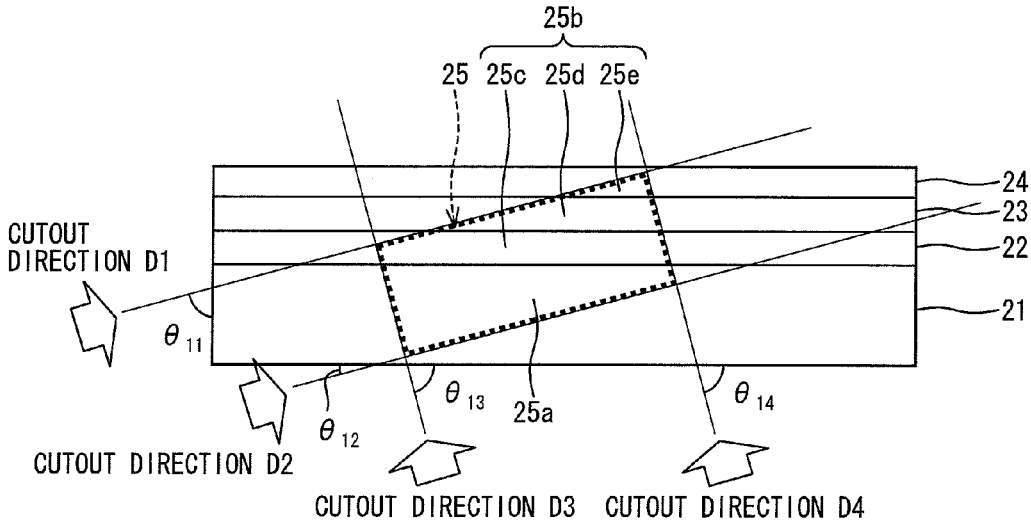
FIG. 4 illustrates a method for preparing a multilayer filter.

First, a plurality of films (here a first layer film 22, a second layer film 23, and a third layer film 24) are sequentially stacked on a substrate 21 by use of a sputtering technique or a vacuum evaporation technique (see FIG. 4).

Thereafter, the substrate 21, the first layer film 22, the second layer film 23, and the third layer film 24 are cut to be divided into multilayer filters 25 in, for example, a cutout direction D1, a cutout direction D2, a cutout direction D3, and a cutout direction D4 in this order. Each of the multilayer filters 25 has a supporting substrate 25*a* and a multilayer film 25*b* and is a rectangular parallelepiped. The supporting substrate 25*a* is a part of the substrate 21. The multilayer film 25*b* has a first layer film 25*c* which is a part of the first layer film 22, a second layer film 25*d* which is a part of the second layer film 23, and a third layer film 25*e* which is a part of the third layer film 24.

Note that only one multilayer filter 25 is illustrated in FIG. 4. However, in a case where such a cutting process as described above is repeatedly carried out, a plurality of multilayer filters 25 can be divided from one substrate 21 on which the first layer film 22, the second layer film 23, and the third layer film 24 are stacked.

The optical path direction of the fluorescence 19 generated from the light emitting section 14 and the stacking direction of the multilayer film 13*b* coincide with each other in FIG. 1 (described earlier). In the case of FIG. 4, it is only necessary that, when the multilayer filter 25 is provided on the window part 16 of the parabolic mirror 15, each of the cutout direction D1 (a cutout angle $\theta_{11}$), the cutout direction D2 (a cutout angle $\theta_{12}$), the cutout direction D3 (a cutout angle $\theta_{13}$), and the cutout direction D4 (a cutout angle $\theta_{14}$) be adjusted so that the optical path direction of the fluorescence 19 which passes through the center of the window part 16 and a stacking direction of the multilayer film 25*b* in which direction the layer films of the multilayer film 25*b* are stacked coincide with each other.

Note that the division into the multilayer filters 25 can be carried out by a polishing process instead of the cutting process.

<Location of the Laser Element 11 with Respect to the Window Part 16>

It is preferable that the laser element 11 be located with respect to the window part 16 so that the laser light 18 emitted from the laser element 11 passes through the center of the window part 16. The following description discusses reasons for this.

Figure 5:
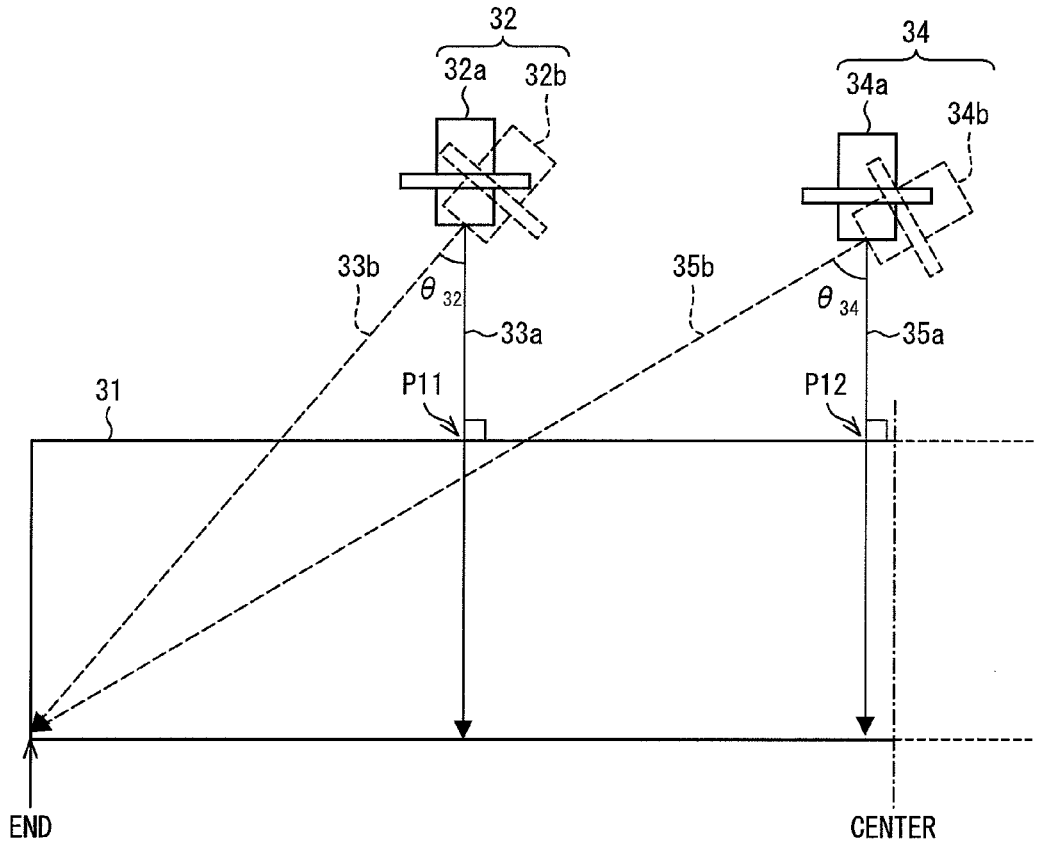
FIG. 5 illustrates a location of a laser element with respect to a window part.

First, the first reason is described below with reference to FIG. 5. It is to be studied what phenomenon occurs in FIG. 1 in each of cases where (i) the laser element 11 is located with respect to the window part 16 so that the laser light 18 passes through the center of the window part 16 and (ii) the laser light 18 passes through a place in the window part 16 which place deviates from the center of the window part 16.

A laser element 32 (32*a*) is located with respect to a window part 31 so that laser light 33*a* emitted from the laser element 32 (32*a*) passes through a place P11 which deviates from a center of the window part 31 toward one end of the window part 31. In contrast, a laser element 34 (34*a*) is located with respect to the window part 31 so that laser light 35*a* emitted from the laser element 34 (34*a*) passes through a place P12 which is in a vicinity of the center of the window part 31 (may be a place which can be substantially regarded as the center). Note here that an angle formed by each of the laser light 33*a* and the laser light 35*a* with respect to an entrance surface of the window part 31 is 90°.

In this case, for example, assume that each of an emission angle of the laser element 32 at which angle the laser element 32 emits the laser light 33*a* and an emission angle of the laser element 34 at which angle the laser element 34 emits the laser light 35*a* deviates as time passes after the beginning of use of the headlamp 101.

First, a maximum value by which the emission angle of the laser element 32 deviates is $\theta_{32}$. This is because the laser light 33*b* emitted from the laser element 32 (32*b*) passes through the end of the window part 31 when the deviation of the emission angle reaches the maximum value of $\theta_{32}$. Therefore, in a case where the deviation of the emission angle exceeds the maximum value of $\theta_{32}$, the laser light emitted from the laser element 32 deviates from the window part 31, so that the laser light fails to go to the inside of the parabolic mirror 15.

In contrast, a maximum value by which the emission angle of the laser element 34 deviates is $\theta_{34}$. This maximum value of $\theta_{34}$ is clearly larger than the maximum value of $\theta_{32}$ for the laser element 32. This is because the laser light 35*b* emitted from the laser element 34 (34*b*) passes through the end of the window part 31 when the deviation of the emission angle reaches the maximum value of $\theta_{34}$.

As described earlier, in a case where the laser element 11 is located with respect to the window part 16 so that the laser light 18 passes through the center of the window part 16, an allowable value for the deviation of the emission angle of the laser element 11 can be maximized. This is the first reason.

In a case where the emission angle of the laser element 11 deviates as described earlier but the laser light 18 can pass through the window part 16, it seems that the laser light 18 may not go toward the light emitting section 14 depending on a scale of the deviation. Namely, the laser light 18 may be brought into direct contact with the metal base 17 without being directed to the light emitting section 14.

Figure 6:
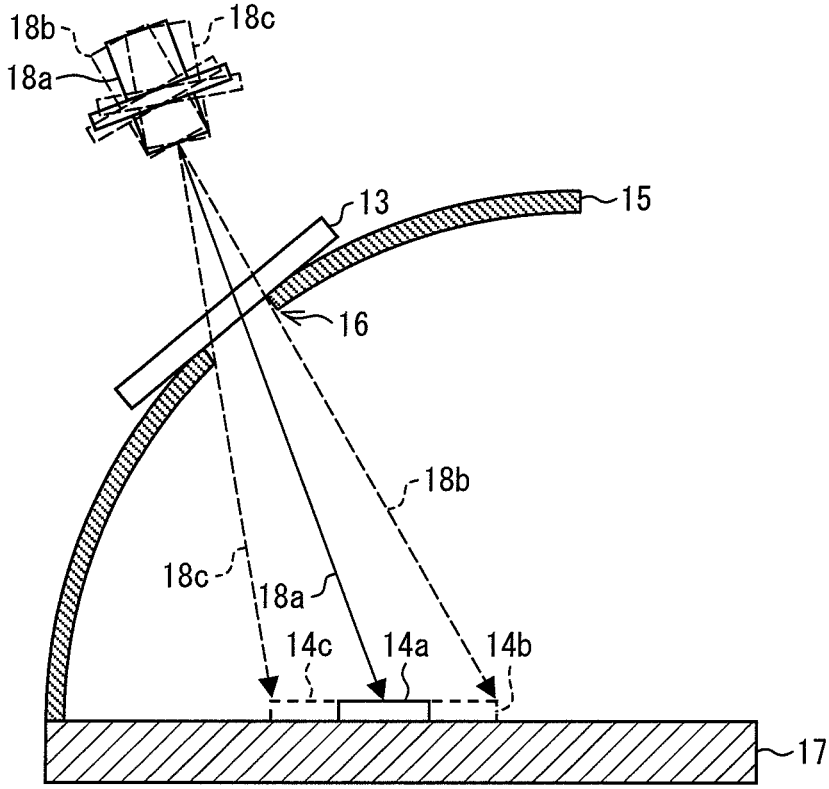
FIG. 6 illustrates a location of a light emitting section with respect to a window part.

In view of the circumstances, for example, it is only necessary to (i) preliminarily calculate a maximum value of the deviation of the emission angle of the laser element 11 as described above and (ii) provide a light emitting section 14*b* and a light emitting section 14*c* at a place on the metal base 17 which place laser light 18*b* and laser light 18*c* each having been emitted from the laser element 11 reach when the deviation occurs (see FIG. 6). Namely, it is only necessary to provide one light emitting section 14 by adding the light emitting section 14*b* and the light emitting section 14*c* to a light emitting section 14*a* which is provided at a place on the metal base 17 which place laser light 18*a* reaches when the deviation of the emission angle does not occur.

Next, the second reason is described below with reference to FIG. 7(*a*) and FIG. 7(*b*). The fluorescence 19 having been emitted from the light emitting section 14 and then entering the window part 16 passes through the center of the window part 16. Propagation distances traveled by the fluorescence 19 in the respective layers (here thicknesses of the respective layers) of the multilayer film 13*b* of the multilayer filter 13 are controlled by use of an entrance direction of the fluorescence 19 passing through the center of the window part 16. A case is studied here where the propagation distances traveled in the respective layers of the multilayer film 13*b* of the multilayer filter 13 are controlled when the laser light 18 emitted from the laser element 11 passes through a place in the window part 16 which place deviates from the center of the window part 16.

Figure 7:
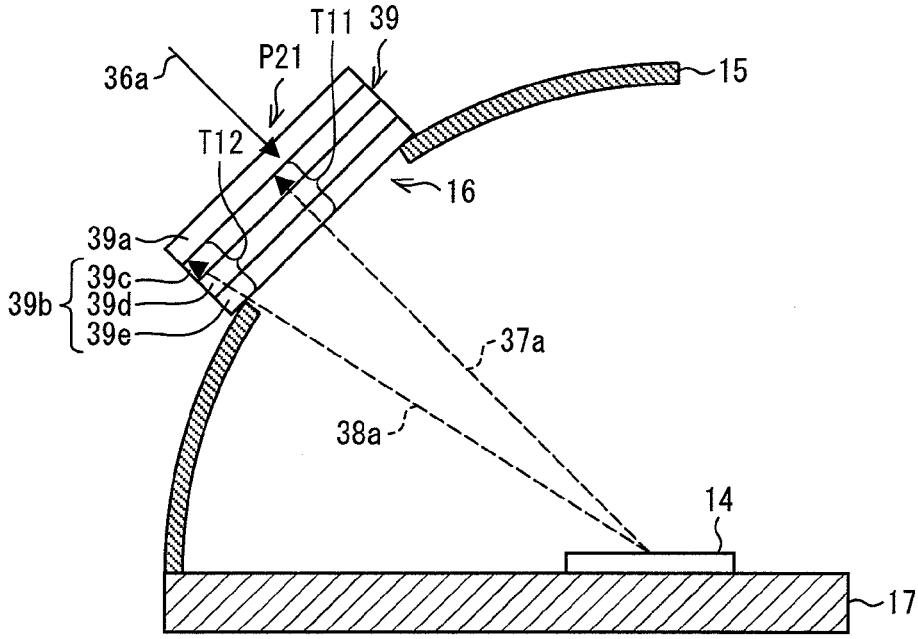
FIG. 7(*a*), which illustrates a location of a laser element with respect to a window part, is a schematic view corresponding to a case where laser light passes through a center of the window part.
Figure 7:
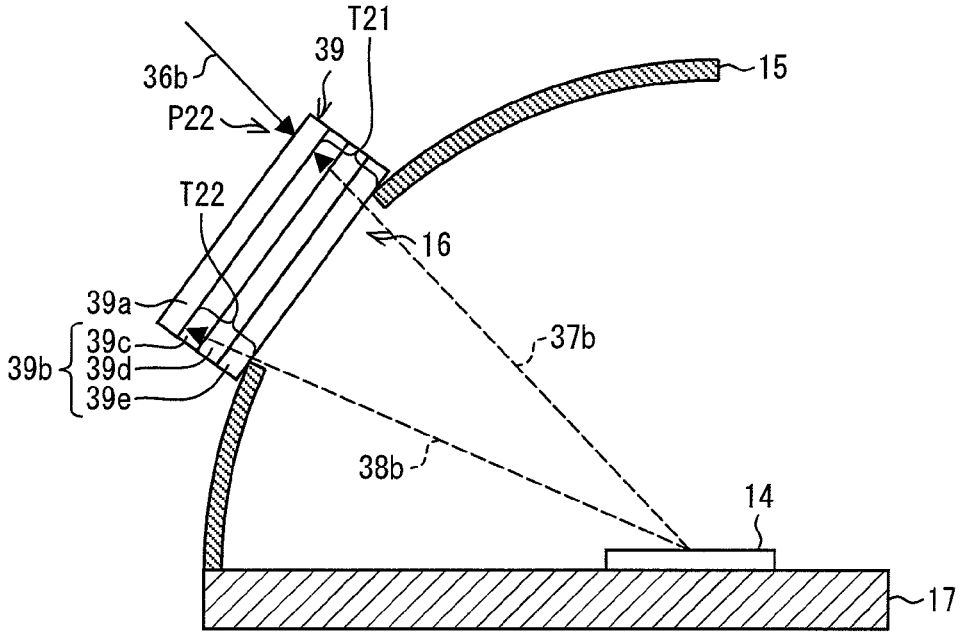

FIG. 7(*a*) is a schematic view illustrating a case where the propagation distances traveled in the respective layers of the multilayer film 13*b* of the multilayer filter 13 are controlled when the laser light 18 emitted from the laser element 11 passes through the center of the window part 16. FIG. 7(*b*) is a schematic view illustrating a case where the propagation distances traveled in the respective layers of the multilayer film 13*b* of the multilayer filter 13 are controlled when the laser light 18 emitted from the laser element 11 passes through a place in the window part 16 which place deviates from the center of the window part 16.

A multilayer filter 39 has a supporting substrate 39*a* and a multilayer film 39*b* which has a first layer film 39*c*, a second layer film 39*d*, and a third layer film 39*e* (see FIG. 7(*a*)). Laser light 36*a* passes through a center P21 of an entrance surface of the multilayer filter 39, i.e., the center of the window part 16. A propagation distance T11 traveled in the multilayer film 39*b* is controlled by use of an entrance direction of fluorescence 37*a* passing through the center of the window part 16.

Note here that an entrance direction of fluorescence 38*a* going from the light emitting section 14 toward an end of the window part 16 is strictly different from the entrance direction of the fluorescence 37*a* passing through the center of the window part 16. Therefore, according to the multilayer film 39*b* in which the propagation distances traveled in the respective layers are controlled by use of the entrance direction of the fluorescence 38*a*, it cannot be said that the propagation distances traveled in the respective layers are most suitable for the fluorescence 38*a*.

Accordingly, a propagation distance T12 traveled by the fluorescence 38*a* passing through the multilayer film 39*b* is different from a propagation distance which is supposed to be controlled by use of the entrance direction of the fluorescence 38*a*.

Laser light 36*b* passes through a place P22 which deviates from the center of the entrance surface of the multilayer filter 39, i.e., a place which deviates from the center of the window part 16. A propagation distance T21 traveled in the multilayer film 39*b* is controlled by use of an entrance direction of fluorescence 37*b* passing through the place which deviates from the center of the window part 16.

Note here that an entrance direction of fluorescence 38*b* going from the light emitting section 14 toward the end of the window part 16 is different from the entrance direction of the fluorescence 37*b*. Therefore, according to the multilayer film 39*b* in which the propagation distances traveled in the respective layers are controlled by use of the entrance direction of the fluorescence 37*b*, it cannot be said that the propagation distances traveled in the respective layers are most suitable for the fluorescence 38*b*.

Accordingly, a propagation distance T22 traveled by the fluorescence 38*b* passing through the multilayer film 39*b* is different from a propagation distance which is supposed to be controlled by use of the entrance direction of the fluorescence 38*b*.

Note here that a comparison between the cases of FIG. 7(*a*) and FIG. 7(*b*) shows a deviation of the propagation distance T12 from the propagation distance T11 in FIG. 7(*a*) is smaller in scale than that of the propagation T22 from the propagation distance T21 in FIG. 7(*b*). This is because a deviation of the entrance direction of the fluorescence 38*a* from the entrance direction of the fluorescence 37*a* in FIG. 7(*a*) is smaller in scale than that of the entrance direction of the fluorescence 38*b* from the entrance direction of the fluorescence 37*b* in FIG. 7(*b*).

Namely, in a case where the laser element 11 is located with respect to the window part 16 so that the laser light 18 passes through the center of the window part 16, a deviation of the entrance direction of the fluorescence 19 emitted from the light emitting section 14 can be minimized. According to this, a deviation of the propagation distances traveled in the multilayer film 13*b* of the multilayer filter 13 can be minimized. This is the second reason.

<Specific Example of the Multilayer Filter 13>

Figures 8, 9:
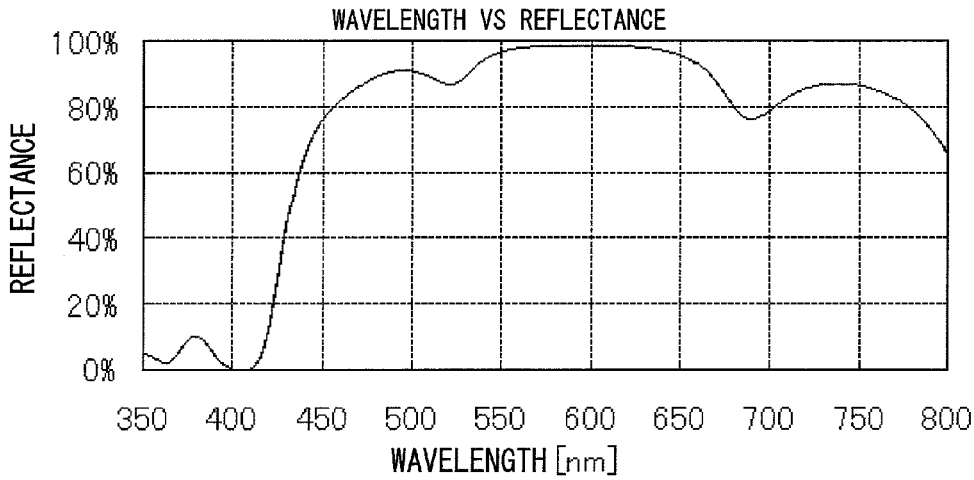
FIG. 8 illustrates a structure of a multilayer filter.
FIG. 9 is a graph showing a reflectance of a multilayer filter with respect to a wavelength.

FIG. 8 illustrates a specific example of the multilayer film 13*b* of the multilayer filter 13. The multilayer film 13*b* is obtained by alternately stacking $TiO_2$ films and $SiO_2$ films in the order of a $TiO_2$ film, a $SiO_2$ film, a $TiO_2$ film, a $SiO_2$ film, . . . from the laser element 11 side, i.e., from the supporting substrate 13*a* side.

FIG. 9 is a graph showing wavelength selectivity of the multilayer filter 13 illustrated in FIG. 8. The multilayer filter 13 has a reflectance of substantially "0%" with respect to the laser light 18 having a wavelength of, for example, 405 nm (see FIG. 9). In contrast, the multilayer filter 13 has a reflectance of substantially "100%" with respect to the fluorescence 19 having a wavelength of, for example, 600 nm.

As described above, the multilayer filter 13 has wavelength selectivity such that transmits light including the laser light 18 and having a wavelength falling within a given range and reflects light including the fluorescence 19 and having a wavelength falling within a given range.

Second Embodiment

The First Embodiment uses the multilayer filter in which the stacking direction of the multilayer film and the entrance direction of the fluorescence coincide with each other. Therefore, preparation of the multilayer filters by division into the multilayer filters requires the cutting process to be carried out in a plurality of cutout directions a plurality of times.

In contrast, according to the Second Embodiment of the present invention, a stacking direction of a multilayer film and an entrance direction of fluorescence do not coincide with each other but the number of times of a cutting process for division into multilayer filters can be reduced instead.

Figure 10:
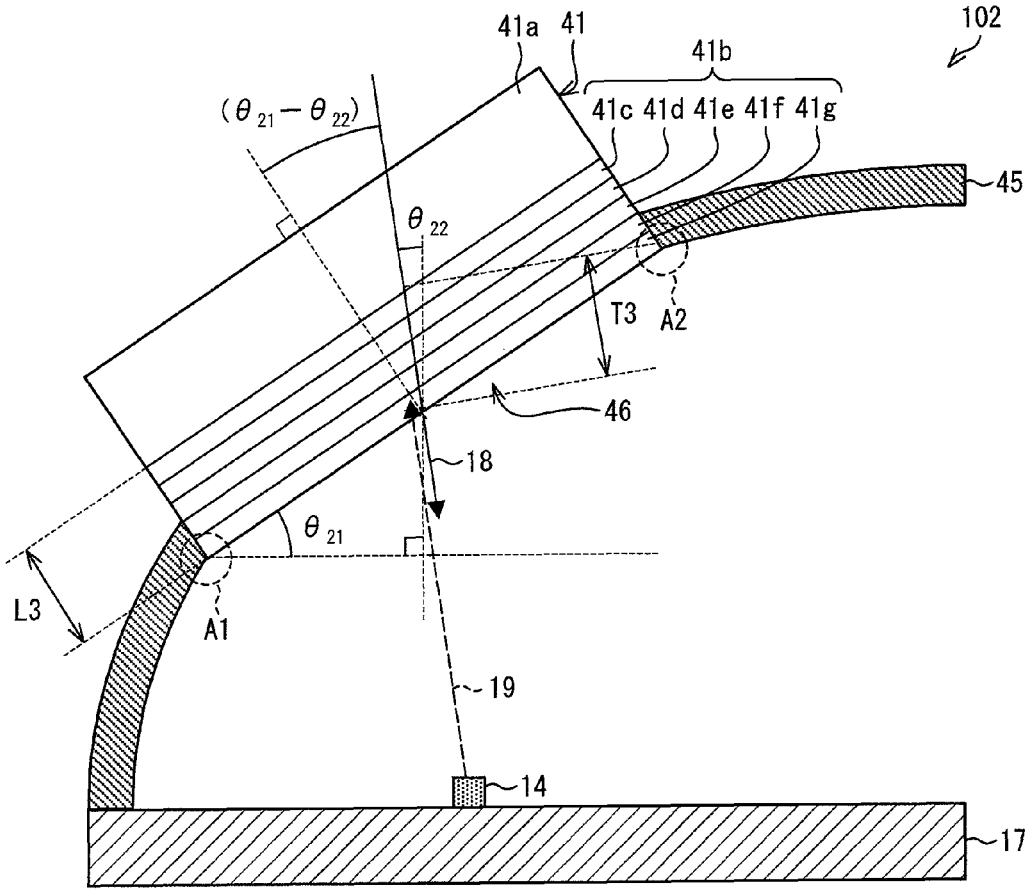
FIG. 10 is a cross-sectional view schematically illustrating an arrangement of a headlamp in accordance with a second embodiment of the present invention.

FIG. 10 is a cross-sectional view schematically illustrating an arrangement of a headlamp 102 in accordance with the Second Embodiment. The headlamp 102 of the Second Embodiment is different from the headlamp 101 of the First Embodiment in that the multilayer filter 13 is replaced with a multilayer filter 41 and the parabolic mirror 15 is replaced with a parabolic mirror 45.

(Multilayer Filter 41)

The multilayer filter 41 has a supporting substrate 41*a* and a multilayer film 41*b* (see FIG. 10). The multilayer film 41*b* is obtained by stacking, on the supporting substrate 41*a*, a first layer film 41*c*, a second layer film 41*d*, a third layer film 41*e*, a fourth layer film 41*f*, and a fifth layer film 41*g* in this order.

A stacking direction of the multilayer film 41*b* of the multilayer filter 41 and an entrance direction of fluorescence 19 emitted from a light emitting section 14 do not coincide with each other. Instead, the stacking direction is at right angles to a surface of the supporting substrate 41*a* which surface is opposite from a surface of the supporting substrate 41*a* on which surface the multilayer film 41*b* is provided. The following description discusses an effect of this structure.

According to the First Embodiment, the propagation distances traveled in the respective layers of the multilayer film 13*b* coincide with the thicknesses of the respective layers by causing the stacking direction of the multilayer film 13*b* and the entrance direction of the fluorescence 19 to coincide with each other. This makes it possible to control the propagation distances traveled in the respective layers of the multilayer film 13*b* by controlling the thicknesses of the respective layers.

However, in exchange of such control of the propagation distances traveled in the respective layers, i.e., facilitation of control of optical path lengths in the respective layers, preparation of multilayer filters 13 by division into the multilayer filters 13 requires the cutting process to be carried out a plurality of times, which is troublesome.

Figure 11:
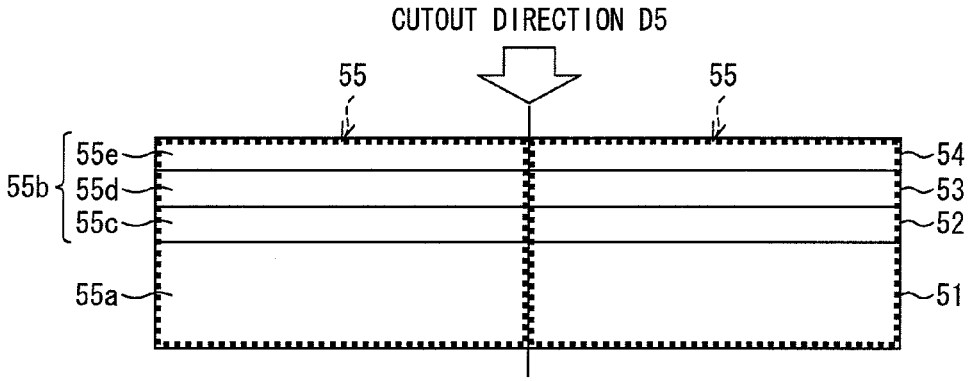
FIG. 11 illustrates a method for preparing a multilayer filter.

In contrast, according to the Second Embodiment, the number of times of such a cutting process can be reduced. Namely, in a case where a plurality of films (here a first layer film 52, a second layer film 53, and a third layer film 54) are sequentially stacked on a substrate 51*a* and then a cutting process is carried out in a cutout direction D5, a plurality of multilayer filters 55 can be divided from one substrate 51 on which the first layer film 52, the second layer film 53, and the third layer film 54 are stacked (see FIG. 11).

Note that each of the plurality of multilayer filters 55 has a supporting substrate 55*a* and a multilayer film 55*b* and is a rectangular parallelepiped. The supporting substrate 55*a* is a part of the substrate 51. The multilayer film 55*b* has a first layer film 55*c* which is a part of the first layer film 52, a second layer film 55*d* which is a part of the second layer film 53, and a third layer film 55*e* which is a part of the third layer film 54.

Note that a propagation distance traveled in the multilayer film 41*b* of the multilayer filter 41 and a thickness of the multilayer film 41*b* do not coincide with each other. Therefore, according to the multilayer filter 41, the propagation distance traveled in the multilayer film 41*b* is converted by use of the thickness of the multilayer film 41*b* based on the following equation and then an optical path length in the multilayer film 41*b* is controlled by use of the propagation distance thus converted.

$$L3=T3\times\mathrm{COS}(\theta_{21}-\theta_{22})$$

In the above equation, L3 is a thickness of the multilayer film 41*b*, T3 is a propagation distance traveled in the multilayer film 41*b*, $\theta_{21}$ is an angle formed by an entrance surface of the multilayer filter 41 from which surface the fluorescence 19 enters the multilayer filter 41 and a horizontal direction, and $\theta_{22}$ is an angle formed by the entrance direction of the fluorescence 19 and a vertical direction. Note here that the horizontal direction is a direction which is parallel to a surface of a metal base 17 on which surface the light emitting section 14 is provided and the vertical direction is a direction which is at right angles to the surface of the metal base 17 on which surface the light emitting section 14 is provided.

(Parabolic Mirror 45)

The parabolic mirror 45 is arranged such that the multilayer filter 41 is embedded in a window part 46. According to this, the entrance surface of the multilayer filter 41 from which surface the fluorescence 19 enters the multilayer filter 41 and a reflecting surface of the parabolic mirror 45 are combined to be continuous. In other words, there occurs no difference in level at connecting points (indicated by A1 and A2 in FIG. 10) of the entrance surface of the multilayer filter 41 from which surface the fluorescence 19 enters the multilayer filter 41 and the parabolic mirror 45.

According to the parabolic mirror 15 of the First Embodiment, an entrance surface of the multilayer filter 13 from which surface the fluorescence 19 enters the multilayer filter 13 and a reflecting surface of the parabolic mirror 15 are discontinuous and there occurs a difference in level between these two surfaces (see FIG. 1 and FIG. 2(*a*)). Reflection of fluorescence due to such a difference in level prevents the fluorescence 19 from going in a direction intended by the parabolic mirror 15 and may cause a decrease in efficiency with which the parabolic mirror 15 extracts the fluorescence 19.

In contrast, according to the parabolic mirror 45, such a difference in level does not occur. This allows the fluorescence 19 to go in a direction intended by the parabolic mirror 45. Therefore, the parabolic mirror 45 can extract the fluorescence 19 with higher efficiency.

Third Embodiment

The First Embodiment is arranged such that the multilayer filter is provided outside the parabolic mirror. Therefore, there occurs a difference in level between the multilayer filter and the parabolic mirror, which are discontinuous.

In contrast, Third Embodiment of the present invention is arranged such that a multilayer filter is embedded in a window part and the multilayer filter and a parabolic mirror are continuous. Such an arrangement of the present embodiment causes no difference in level between the multilayer filter and the parabolic mirror.

Figure 12:
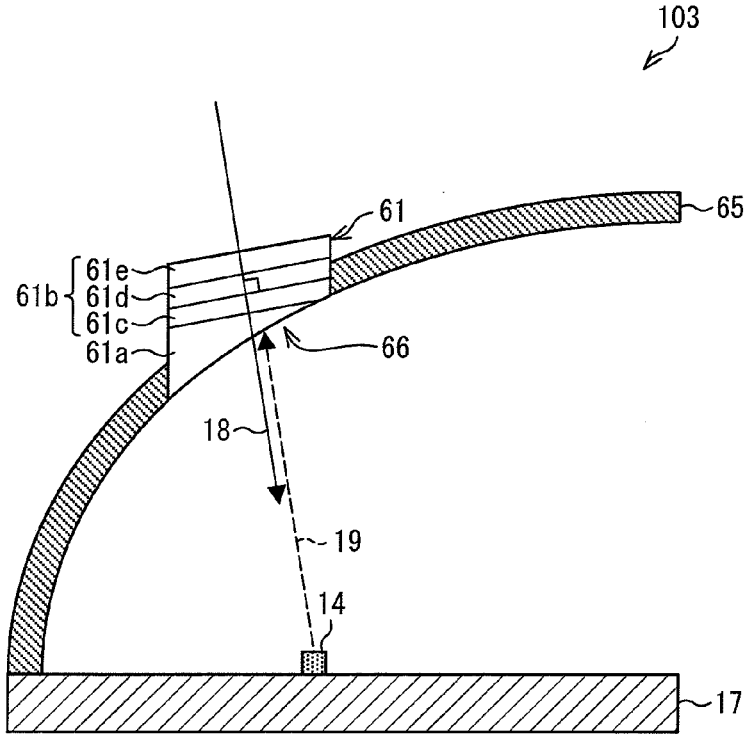
FIG. 12 is a cross-sectional view schematically illustrating an arrangement of a headlamp in accordance with a third embodiment of the present invention.

FIG. 12 is a cross-sectional view schematically illustrating an arrangement of a headlamp 103 in accordance with the Third Embodiment. The headlamp 103 of the Third Embodiment is different from the headlamp 101 of the First Embodiment in that the multilayer filter 13 is replaced with a multilayer filter 61 and the parabolic mirror 15 is replaced with a parabolic mirror 65.

(Multilayer Filter 61)

The multilayer filter 61 has a supporting substrate 61*a* and a multilayer film 61*b* (see FIG. 12). The multilayer film 61*b* is obtained by stacking, on the supporting substrate 61*a*, a first layer film 61*c*, a second layer film 61*d*, and a third layer film 61*e* in this order.

The multilayer filter 61 is arranged such that the supporting substrate 61*a* faces a light emitting section 14. An entrance surface of the supporting substrate 61*a* from which surface fluorescence 19 enters the supporting substrate 61*a* is curved so that the entrance surface of the supporting substrate 61*a* from which surface fluorescence enters the supporting substrate 61*a* and a reflecting surface of the parabolic mirror 65 are combined to be continuous. Namely, the entrance surface of the supporting substrate 61*a* from which surface fluorescence 19 enters the supporting substrate 61*a* is a part of the reflecting surface of the parabolic mirror 65. The entrance surface of the supporting substrate 61*a* from which surface fluorescence 19 enters the supporting substrate 61*a* and the reflecting surface of the parabolic mirror 65 are combined to form a single curved surface when seen from the light emitting section 14 side.

The light emitting section 14 is located substantially at a focal point of the reflecting surface thus combined. This allows the fluorescence 19 to go in a direction intended by the parabolic mirror 65. Therefore, the parabolic mirror 65 can extract the fluorescence 19 with higher efficiency.

Note that it is preferable that a curvature of the entrance surface of the supporting substrate 61*a* from which surface fluorescence 19 enters the supporting substrate 61*a* and a curvature of the reflecting surface of the parabolic mirror 65 perfectly coincide with each other. However, an increase in efficiency with which the parabolic mirror 65 extracts the fluorescence 19 can be expected merely by curving the entrance surface of the supporting substrate 61*a* from which surface fluorescence 19 enters the supporting substrate 61*a*.

Figure 13:
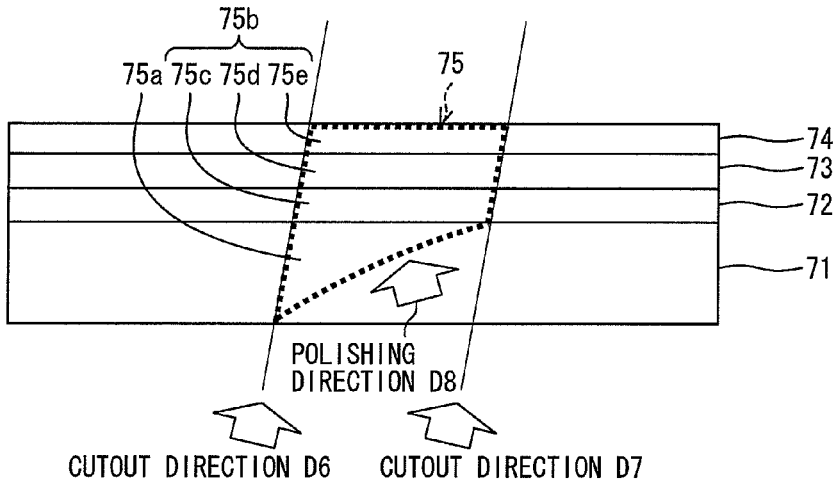
FIG. 13 illustrates a method for preparing a multilayer filter.

The multilayer filter 61 is obtained by, for example, sequentially stacking a plurality of films (here a first layer film 72, a second layer film 73, and a third layer film 74) on a substrate 71 and then carrying out a cutting process in a cutout direction D6 and a cutout direction D7 (see FIG. 13). Further, a polishing process is carried out in a polishing direction D8, so that a plurality of multilayer filters 75 can be divided from one substrate 71 on which the first layer film 72, the second layer film 73, and the third layer film 74 are stacked.

Note that each of the plurality of multilayer filters 75 has a supporting substrate 75*a* and a multilayer film 75*b*. The supporting substrate 75*a* is a part of the substrate 71. The multilayer film 75*b* has a first layer film 75*c* which is a part of the first layer film 72, a second layer film 75*d* which is a part of the second layer film 73, and a third layer film 75*e* which is a part of the third layer film 74.

(Parabolic Mirror 65)

The parabolic mirror 65 is arranged such that the multilayer filter 61 is embedded in a window part 66. There occurs no difference in level at connecting points of an entrance surface of the multilayer filter 61 from which surface the fluorescence 19 enters the multilayer filter 61 and the parabolic mirror 65.

Fourth Embodiment

Fourth Embodiment of the present invention is arranged such that the entrance surface of the multilayer filter from which surface the fluorescence enters the multilayer filter is further curved in the Second Embodiment.

Figure 14:
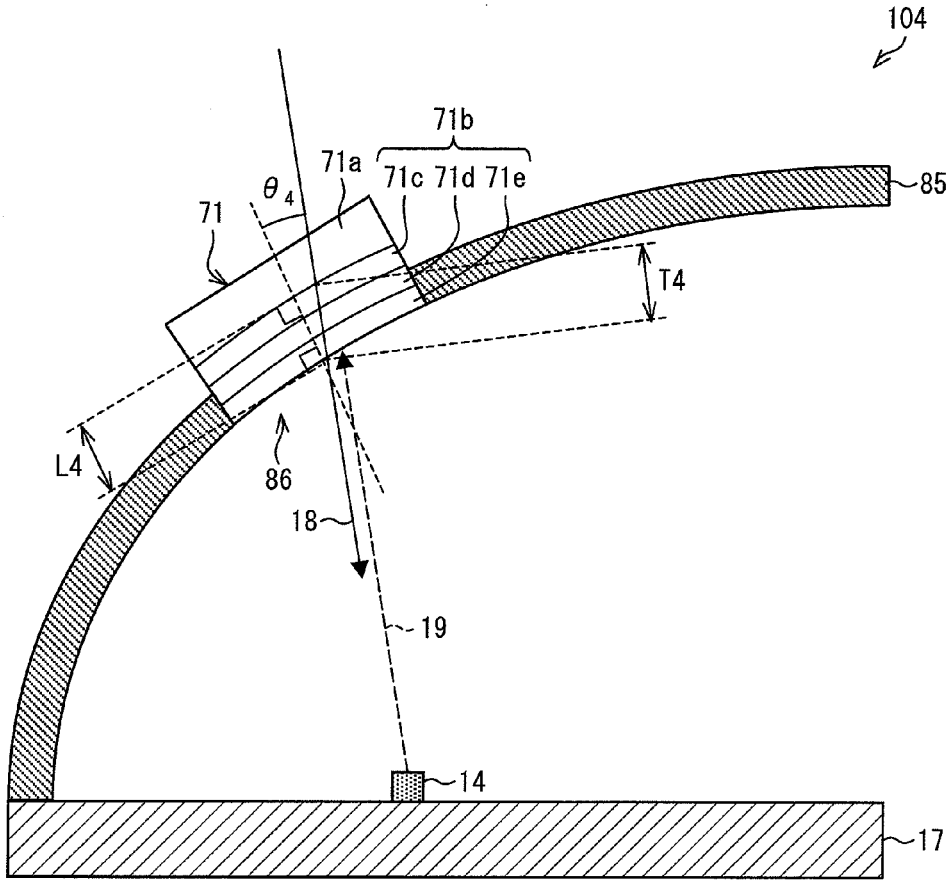
FIG. 14 is a cross-sectional view schematically illustrating an arrangement of a headlamp in accordance with a fourth embodiment of the present invention.

FIG. 14 is a cross-sectional view schematically illustrating an arrangement of a headlamp 104 in accordance with the Fourth Embodiment. The headlamp 104 of the Fourth Embodiment is different from the headlamp 102 of the Second Embodiment in that the multilayer filter 41 is replaced with a multilayer filter 71 and the parabolic mirror 45 is replaced with a parabolic mirror 85 having a window part 86.

The multilayer filter 71 has a supporting substrate 71*a* and a multilayer film 71*b* (see FIG. 14). The multilayer film 71*b* is obtained by stacking, on the supporting substrate 71*a*, a first layer film 71*c*, a second layer film 71*d*, and a third layer film 71*e* in this order.

The multilayer filter 71 is arranged such that an entrance surface of the multilayer film 71*b* from which surface fluorescence 19 enters the multilayer film 71*b* is curved so that the entrance surface of the multilayer film 71*b* from which surface fluorescence 19 enters the multilayer film 71*b* and a reflecting surface of the parabolic mirror 85 are combined to be continuous. Namely, the entrance surface of the multilayer film 71*b* from which surface fluorescence 19 enters the multilayer film 71*b* is a part of the reflecting surface of the parabolic mirror 85. The entrance surface of the multilayer film 71*b* from which surface fluorescence 19 enters the multilayer film 71*b* and the reflecting surface of the parabolic mirror 85 are combined to form a single curved surface when seen from the light emitting section 14 side.

The light emitting section 14 is located substantially at a focal point of the reflecting surface thus combined. This allows the fluorescence 19 to go in a direction intended by the parabolic mirror 85. Therefore, the parabolic mirror 85 can extract the fluorescence 19 with higher efficiency.

Figure 15:
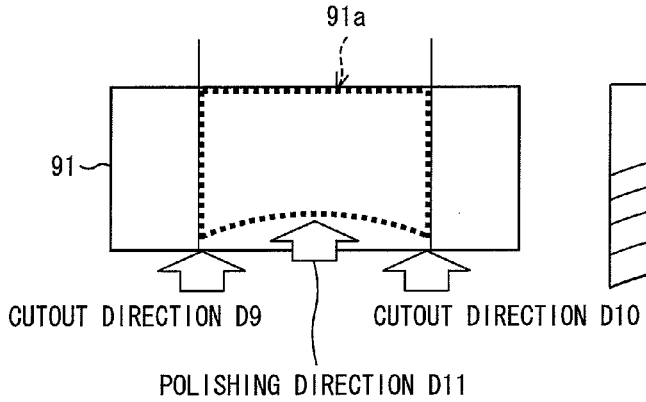
FIG. 15(*a*) illustrates a method for preparing a multilayer filter.
Figure 15:
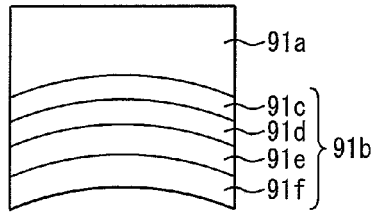

The multilayer filter 71 is obtained by, for example, carrying out a cutting process in a cutout direction D9 and a cutout direction D10 (see FIG. 15(*a*)). Further, a polishing process is carried out in a polishing direction D11, so that a plurality of supporting substrates 91*a* are divided from one substrate 91. Then, it is only necessary that a plurality of films (here a first layer film 91*c*, a second layer film 91*d*, a third layer film 91*e*, and a fourth layer film 91*f*) be sequentially stacked on each of the plurality of supporting substrates 91*a* (see FIG. 15(*b*)). In a case where the plurality of films are stacked on a curved surface of a supporting substrate 91*a* which surface has been subjected to the polishing process, the entrance surface of the multilayer film 71*b* from which surface fluorescence 19 enters the multilayer film 71*b* can be curved as described earlier.

Note that a propagation distance traveled in the multilayer film 71*b* of the multilayer filter 71 and a thickness of the multilayer film 71*b* do not coincide with each other. Therefore, according to the multilayer filter 71, the propagation distance traveled in the multilayer film 71*b* is converted by use of the thickness of the multilayer film 71*b* based on the following equation and then an optical path length in the multilayer film 71*b* is controlled by use of the propagation distance thus converted.

$$L4=T4\times\cos\theta_4$$

In the above equation, L4 is a thickness of the multilayer film 71*b*, T4 is a propagation distance traveled in the multilayer film 71*b*, and $\theta_4$ is an angle formed by a stacking direction of the multilayer film 71*b* and an entrance direction of the fluorescence 19.

Fifth Embodiment

Fifth Embodiment of the present invention is arranged such that the multilayer filter of the Second Embodiment has a protrusion, so as to prevent the multilayer filter from falling from the window part into an inside of the parabolic mirror.

Figure 16:
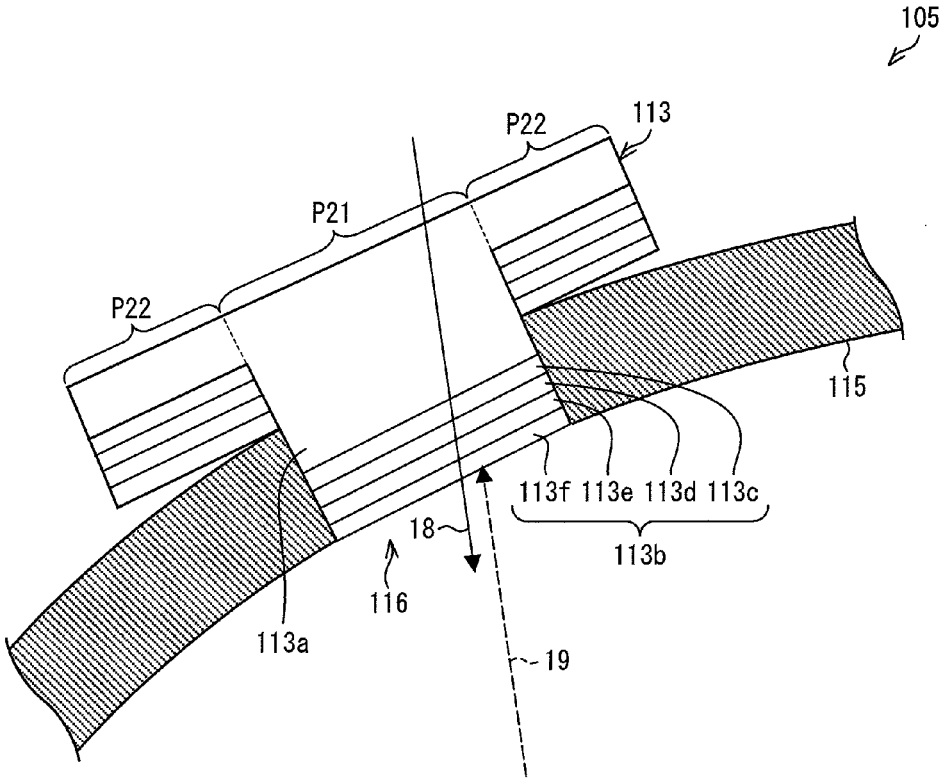
FIG. 16 is a cross-sectional view schematically illustrating an arrangement of a headlamp in accordance with a fifth embodiment of the present invention.

FIG. 16 is a cross-sectional view schematically illustrating an arrangement of a headlamp 105 in accordance with the Fifth Embodiment. The headlamp 105 of the Fifth Embodiment is different from the headlamp 102 of the Second Embodiment in that the multilayer filter 41 is replaced with a multilayer filter 113 and the parabolic mirror 45 is replaced with a parabolic mirror 115.

The multilayer filter 113 has a protrusion constituted by a tip P21 and a base P22 (see FIG. 16).

The tip P21 has a supporting substrate 113*a* and a multilayer film 113*b*. The multilayer film 113*b* is obtained by stacking, on the supporting substrate 113*a*, a first layer film 113*c*, a second layer film 113*d*, a third layer film 113*e*, and a fourth layer film 113*f* in this order.

The tip P21, which corresponds to the multilayer filter 41 of the Second Embodiment, has wavelength selectivity which is identical to that of the multilayer filter 41.

In contrast, the base P22, which is not involved in realization of wavelength selectivity of the multilayer filter 113, prevents the tip P21 from falling from a window part 116 of the parabolic mirror 115 into an inside of the parabolic mirror 115.

The base P22 allows stable provision of the multilayer filter 113 in the window part 116 of the parabolic mirror 115. Therefore, it is unnecessary to adhere the multilayer filter 113 to the window part 116 by use of, for example, an adhesive. This facilitates attachment/detachment of the multilayer filter 113 to/from the window part 116 and replacement of the multilayer filter 113 which has been broken, for example.

It is only necessary that the multilayer filter 113 having the tip P21 and the base P22 be obtained by, for example, preparing the supporting substrate 113*a* which has been preliminarily formed to have a protrusion and then stacking, on a surface of the supporting substrate 113*a* which surface has the protrusion, the first layer film 113*c*, the second layer film 113*d*, the third layer film 113*e*, and the fourth layer film 113*f* in this order. In this case, the first layer film 113*c*, the second layer film 113*d*, the third layer film 113*e*, and the fourth layer film 113*f* are also stacked on an upper part of a part of the supporting substrate 113, the part constituting the base P22.

Sixth Embodiment

Sixth Embodiment of the present invention is arranged such that the window part of the Second Embodiment has a smaller aperture area from an outer surface toward an inner surface of the parabolic mirror, so as to prevent the multilayer filter from falling from the window part into an inside of the parabolic mirror.

Figure 17:
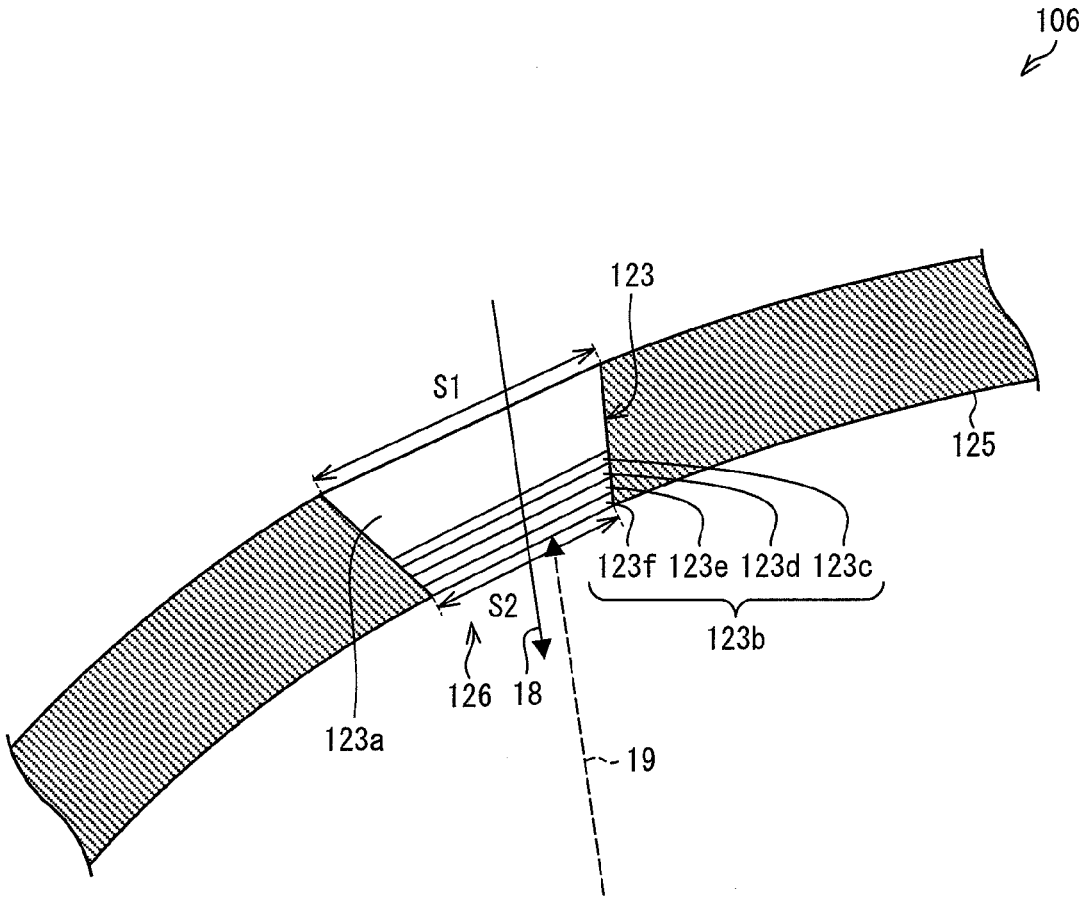
FIG. 17 is a cross-sectional view schematically illustrating an arrangement of a headlamp in accordance with a sixth embodiment of the present invention.

FIG. 17 is a cross-sectional view schematically illustrating an arrangement of a headlamp 106 in accordance with the Sixth Embodiment. The headlamp 106 of the Sixth Embodiment is different from the headlamp 102 of the Second Embodiment in that the multilayer filter 41 is replaced with a multilayer filter 123 and the parabolic mirror 45 is replaced with a parabolic mirror 125.

The multilayer filter 123 has a supporting substrate 123*a* and a multilayer film 123*b* (see FIG. 17). The multilayer film 123*b* is obtained by stacking, on the supporting substrate 123*a*, a first layer film 123*c*, a second layer film 123*d*, a third layer film 123*e*, and a fourth layer film 123*f* in this order.

A window part 126 of the parabolic mirror 125 has a smaller aperture area from an outer surface toward an inner surface of the parabolic mirror 125. Specifically, an aperture area S2 of the inner surface of the parabolic mirror 125 is smaller than an aperture area S1 of the outer surface of the parabolic mirror 125. An aperture area of the window part 126 gradually changes (decreases) from S1 to S2 from the outer surface toward the inner surface of the parabolic mirror 125.

The multilayer filter 123 has a smaller cross-sectional area from the outer surface toward the inner surface of the parabolic mirror 125 so as to be embedded in the window part 126 having such an aperture area. Namely, the multilayer filter 123 is narrower from the outer surface toward the inner surface of the parabolic mirror 125 (see FIG. 17).

Therefore, the multilayer filter 123 does not slip through the window part 126 while being embedded in the window part 126. Accordingly, it is unnecessary to adhere the multilayer filter 123 to the window part 126 by use of, for example, an adhesive. This facilitates attachment/detachment of the multilayer filter 123 to/from the window part 126 and replacement of the multilayer filter 123 which has been broken, for example.

[Method for Assembling Headlamp of the Present Invention]

Figure 18:
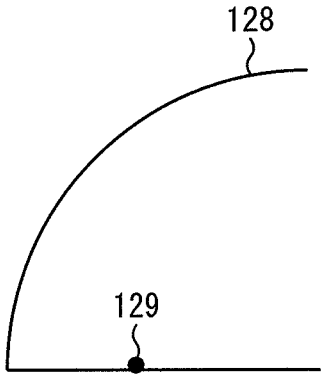
FIG. 18(*a*) illustrates a method for assembling a headlamp of the present invention.
Figure 18:
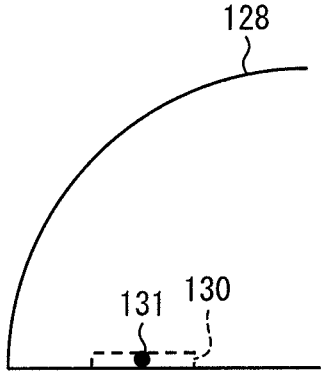
Figure 18:
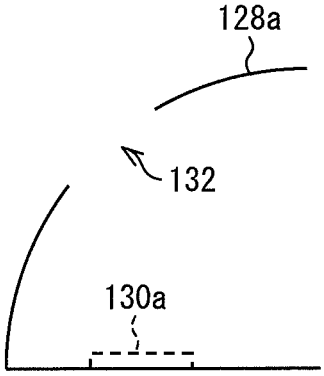
Figure 18:
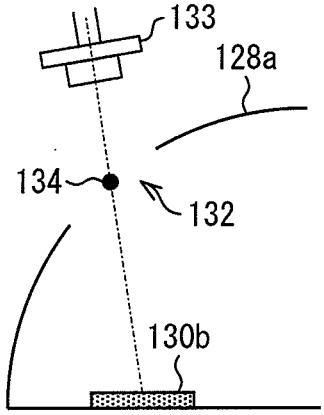

Each of Figs. (a) through FIG. 18(*d*) illustrates an example of a method for assembling a headlamp of the present invention. A shape, a size, and the like of a parabolic mirror 128 are designed, so as to determine a focal point 129 of the parabolic mirror 128 (see FIG. 18(*a*)).

Next, a place in which a light emitting section 130 is to be provided is determined so that a focal point 131 is located in the place (see FIG. 18(*b*)).

Next, a place in a parabolic mirror 128*a* in which place a window part 132 is to be provided is determined based on where a light emitting section 130*a* is provided, so that the window part 132 is provided in the place thus determined (see FIG. 18(*c*)).

Finally, a location of a laser element 133 is determined so that laser light travels on a line defined by a light emitting section 130*b* and a central point 134 of the window part 132 (see FIG. 18(*d*)).

[Example of Use of the Present Invention]

A light emitting apparatus of the present invention may be used for a vehicle headlamp and other illuminating apparatuses. An illuminating apparatus of the present invention is exemplified by a laser downlight. The laser downlight is an illuminating apparatus provided on a ceiling of a structure such as a house or a vehicle. Besides, the illuminating apparatus of the present invention may be used as a headlamp for a mobile object other than a vehicle (e.g., human beings, a vessel, an aircraft, a submersible, or a rocket). Alternatively, the illuminating apparatus of the present invention may be used as an interior lamp other than a search light, a projector, and a downlight (e.g., a stand lamp).

SUMMARY OF EMBODIMENTS

As described earlier, a light emitting apparatus in accordance with the present embodiments includes: an excitation light source which emits excitation light; a light emitting section which generates fluorescence in response to the excitation light emitted from the excitation light source; a reflecting mirror which reflects the fluorescence generated by the light emitting section; and an optical functional member which transmits the excitation light and reflects the fluorescence, the excitation light source being provided outside the reflecting mirror, the reflecting mirror being provided with a light passage opening through which the excitation light passes, and the optical functional member being provided so as to cover the light passage opening.

According to the arrangement, the light emitting section generates fluorescence in response to the excitation light emitted from the excitation light source and the reflecting mirror reflects the fluorescence, so that the fluorescence is emitted as illumination light. The excitation light source is provided outside the reflecting mirror. The excitation light emitted from the excitation light source passes through the light passage opening which is provided in the reflecting mirror, so as to be directed to the light emitting section.

Note here that the light emitting section which is irradiated with the excitation light generates the fluorescence radially centering on itself. Therefore, a part of the fluorescence generated by the light emitting section goes toward the light passage opening through which the excitation light passes.

In this case, if the fluorescence going toward the light passage opening of the reflecting mirror passes straight through the light passage opening, the fluorescence leaks to the outside of the reflecting mirror. The fluorescence thus having leaked cannot be used as the illumination light of the light emitting apparatus.

This means a reduction in efficiency with which the fluorescence is used and consequently a reduction in brightness of the illumination light of the light emitting apparatus.

In view of the circumstances, according to the arrangement, the optical functional member is used to cover the light passage opening of the reflecting mirror. The optical functional member transmits the excitation light emitted from the excitation light source and reflects the fluorescence generated by the light emitting section.

Further, according to the arrangement, the optical functional member, which is provided at the light passage opening of the reflecting mirror, is spatially away from the light emitting section. Therefore, the fluorescence can be considered to enter the optical functional member substantially unidirectionally.

Therefore, since it is possible to prevent the fluorescence from leaking to the outside of the reflecting mirror from the light emitting section side, it is possible to enhance efficiency with which the fluorescence generated by the light emitting section is used.

It is preferable that the excitation light source be located with respect to the light passage opening so that the excitation light passes through a center of the light passage opening.

For example, the excitation light source is positioned while the light emitting apparatus is being assembled. During the positioning, an emission angle at which the excitation light source emits the excitation light with respect to the light passage opening is determined so that the excitation light emitted from the excitation light source passes through the light passage opening without fail.

However, the emission angle of the excitation light source may deviate as time passes. When the deviation becomes great, an optical path of the excitation light deviates from the light passage opening, so that the excitation light cannot pass through the light passage opening. Accordingly, it can be said that a larger allowable value for the deviation of the emission angle is preferable.

In view of the circumstances, according to the arrangement, the excitation light source is located with respect to the light passage opening so that the excitation light passes through a center of the light passage opening. In this case, if the emission angle of the excitation light source starts deviating, the optical path of the excitation light starts deviating from the center of the light passage opening. This means that it is possible to maximize a scale of the deviation of the emission angle which scale is necessary for the optical path of the excitation light to deviate from the light passage opening.

Therefore, according to the arrangement, it is possible to maximize an allowable value for the emission angle of the excitation light source.

It is preferable that the light emitting section be located with respect to the light passage opening so as to be irradiated with the excitation light even in a case where the excitation light emitted from the excitation light source passes through any place in the light passage opening.

It seems that, in a case where the emission angle of the excitation light source deviates but the excitation light can pass through the light passage opening, the excitation light may not go toward the light emitting section depending on a scale of the deviation.

According to the arrangement, even in a case where the excitation light emitted from the excitation light source passes through a place in the light passage opening which place deviates from the center toward an end of the light passage opening, the excitation light is directed to the light emitting section.

It is preferable that: the optical functional member have a supporting substrate and a layer stack, the layer stack being provided on an upper part of the supporting substrate and having a multilayer structure of a plurality of films; and the layer stack transmit light including the excitation light and having a wavelength falling within a first range and reflect light including the fluorescence and having a wavelength falling within a second range.

According to the arrangement, the optical functional member has a layer stack having a multilayer structure of a plurality of films and uses the layer stack to transmit the excitation light and reflect the fluorescence. Note here that the layer stack, which is obtained by multilayering a plurality of films including an $SiO_2$ film and a $TiO_2$ film, is normally extremely low in strength. Therefore, in a case where the layer stack alone is to be provided on the light passage opening of the reflecting mirror, deformation and/or breakage may occur in the layer stack due to a low strength of the layer stack. Alternatively, it also seems that such deformation and/or breakage may occur while the light emitting apparatus is being used.

In view of the circumstances, according to the arrangement, the layer stack which is low in strength as described above is provided on the upper part of the supporting substrate such as an $SiO_2$ substrate. According to this, the layer stack which is supported by the supporting substrate has a higher strength than the layer stack which is used alone. This can prevent such deformation and/or breakage as described above.

It is preferable that the layer stack side of the optical functional member face the light emitting section.

The supporting substrate, which supports the layer stack, is exemplified by the $SiO_2$ substrate. It is common that such a supporting substrate transmits not only the excitation light emitted from the excitation light source but also the fluorescence generated by the light emitting section.

Note here that, in a case where the supporting substrate side of the optical functional member faces the light emitting section, the fluorescence generated by the light emitting section enters the supporting substrate first when the fluorescence generated by the light emitting section reaches the optical functional member.

As described earlier, the supporting substrate transmits the fluorescence. Therefore, the fluorescence having passed through the supporting substrate may be reflected by the layer stack and then leak from the reflecting mirror depending on a positional relationship between the optical functional member and the light passage opening, e.g., in a case where the fluorescence has been reflected by the layer stack outside the reflecting mirror.

In view of the circumstances, according to the arrangement, the layer stack side of the optical functional member faces the light emitting section. This means that the fluorescence generated by the light emitting section enters the layer stack first when the fluorescence reaches the optical functional member. In this case, when the fluorescence generated by the light emitting section reaches the optical functional member, the fluorescence is reflected by the layer stack. This reduces an amount of the fluorescence which enters the optical functional member and goes toward the outside of the reflecting mirror, so that such a leak of the fluorescence as described above is less likely to occur.

Therefore, it is possible to enhance efficiency with which the fluorescence is used.

It is preferable that the optical functional member be provided so that a stacking direction of the layer stack in which direction the plurality of films are stacked and an optical path direction of the fluorescence coincide with each other.

Distances (propagation distances) traveled by the fluorescence in the respective plurality of films of the layer stack of the optical functional member are controlled so that the fluorescence can be reflected.

Note here that, in a case where the propagation distances traveled by the fluorescence in the respective plurality of films and thicknesses of the respective plurality of films do not coincide with each other, i.e., in a case where the stacking direction of the layer stack and the optical path direction of the fluorescence do not coincide with each other, the propagation distances traveled by the fluorescence in the respective plurality of films need to be controlled again after the plurality of films are stacked. For example, an arrangement of the excitation light source and/or the light emitting section needs to be adjusted and/or the optical functional member needs to be provided again, which requires troublesome operation.

According to the arrangement, since the optical path direction of the fluorescence generated by the light emitting section and the stacking direction of the layer stack coincide with each other, the propagation distances traveled by the fluorescence in the respective plurality of films and the thicknesses of the respective plurality of films coincide with each other. Therefore, control of the thicknesses of the respective plurality of films substantially means control of the propagation distances traveled by the fluorescence in the respective plurality of films.

Therefore, according to the arrangement, control of the thicknesses of the respective plurality of films of the layer stack controls the propagation distances traveled by the fluorescence in the respective plurality of films. This enhances convenience for a user.

It is preferable that the excitation light be P polarized light with respect to the optical functional member and enter the optical functional member at an angle of a Brewster angle.

According to the arrangement, since the excitation light which is P polarized light enters the optical functional member at an angle of a Brewster angle, the excitation light is hardly reflected by an entrance surface of the optical functional member and enters the optical functional member. Then, the excitation light passes through the light passage opening, so as to be directed to the light emitting section.

This allows a reduction in loss of the excitation light inside the optical functional member, so that the excitation light can be directed to the light emitting section with high efficiency. Namely, the excitation light is used with higher efficiency.

It is preferable that the optical functional member be embedded in the light passage opening so that a surface of the optical functional member which surface faces the light emitting section and a reflecting surface of the reflecting mirror are combined to be continuous.

According to the arrangement, at a connecting point of the surface of the optical functional member which surface faces the light emitting section and the reflecting surface of the reflecting mirror, there is no difference in level between these two surfaces. This can make a reflecting surface with respect to the fluorescence generated by the light emitting section, the reflecting surface being a combined surface in which two surfaces are continuous.

Reflection of the fluorescence due to such a difference in level prevents the fluorescence from going in a direction intended by the reflecting mirror and consequently causes a decrease in efficiency with which the reflecting mirror extracts the fluorescence.

In view of the circumstances, the arrangement removes such a difference in level. This can prevent a decrease in efficiency with which the fluorescence is extracted.

It is preferable that the optical functional member be provided so that the stacking direction in which the plurality of films are stacked is at right angles to a surface of the supporting substrate which surface is opposite from a surface of the supporting substrate on which surface the layer stack is provided.

The arrangement can reduce the number of times of cutting out the plurality of films and the supporting substrate after the plurality of films are stacked on the upper part of the supporting substrate. This can facilitate preparation of the optical functional member.

In a case where the stacking direction in which the plurality of films are stacked is not at right angles to the surface of the supporting substrate which surface is opposite from a surface of the supporting substrate on which surface the layer stack is provided, the plurality of films and the supporting substrate need to be cut out in a plurality of cutout directions many times after the plurality of films are stacked on the upper part of the supporting substrate.

According to the arrangement, the stacking direction in which the plurality of films are stacked is at right angles to the surface of the supporting substrate which surface is opposite from a surface of the supporting substrate on which surface the layer stack is provided. Therefore, it is only necessary that, after the plurality of films are stacked on the upper part of the supporting substrate, the plurality of films and the supporting substrate be cut out in a direction which is at right angles to the surface of the supporting substrate which surface is opposite from a surface of the supporting substrate on which surface the layer stack is provided.

This can facilitate preparation of the optical functional member as described earlier.

It is preferable that the surface of the optical functional member which surface faces the light emitting section be a recessed curved surface.

In a case where the fluorescence generated by the light emitting section is reflected by the optical functional member, the arrangement allows the fluorescence going in the direction intended by the reflecting mirror to be larger in amount as compared to an arrangement in which the surface of the optical functional member which surface faces the light emitting section is a flat surface.

This can enhance efficiency with which the fluorescence is extracted.

It is preferable that: the recessed curved surface and the reflecting surface of the reflecting mirror have identical curvatures; and the recessed curved surface and the reflecting surface of the reflecting mirror be combined to form a single reflecting surface with respect to the fluorescence when seen from the light emitting section side.

According to the arrangement, the recessed curved surface of the optical functional member which surface faces the light emitting section and the reflecting surface of the reflecting mirror have identical curvatures, and the recessed curved surface and the reflecting surface of the reflecting mirror are combined to form a single reflecting surface which reflects the fluorescence generated by the light emitting section.

This allows the fluorescence reflected by the recessed curved surface of the optical functional member to go in a direction identical to the direction intended by the reflecting mirror. Note here that, in a case where the recessed curved surface of the optical functional member and the reflecting surface of the reflecting mirror have different curvatures and cannot be regarded as a single reflecting mirror, a direction in which the fluorescence reflected by the recessed curved surface of the optical functional member goes and a direction in which the fluorescence reflected by the reflecting mirror goes cannot coincide with each other.

Therefore, the arrangement allows the fluorescence to be extracted with higher efficiency as compared to the case where the recessed curved surface of the optical functional member and the reflecting surface of the reflecting mirror have different curvatures and cannot be regarded as a single reflecting mirror.

It is preferable that: the optical functional member have a tip and a base, the tip being embedded in the light passage opening, and the base being located outside the reflecting mirror, and having a larger area than an aperture plane of the light passage opening when seen from the light emitting section side.

According to the arrangement, the tip is embedded in the light passage opening while the optical functional member is being provided so as to cover the light passage opening. In this case, since the base, which is larger than the aperture plane of the light passage opening, is not embedded in the light passage opening.

Namely, the base prevents the entire optical functional member from entering the light passage opening.

This prevents the optical functional member from falling from the light passage opening into the reflecting mirror toward the light emitting section. Further, it is unnecessary to provide the optical functional member by, for example, fixing the optical functional member to the light passage opening (e.g., adhering the optical functional member to the light passage opening by use of an adhesive). This facilitates replacement of the optical functional member.

It is preferable that: when seen from the light emitting section side, the aperture plane of the light passage opening have a smaller area from an outer surface toward an inner surface of the reflecting mirror, the inner surface facing the light emitting section; and when seen from the light emitting section side, the optical functional member have a smaller area from the outer surface toward the inner surface of the reflecting mirror so that the optical functional member is embedded in the light passage opening.

According to the arrangement, the optical functional member is embedded in the light passage opening while being provided so as to cover the light passage opening.

Note here that, when seen from the light emitting section side, the aperture plane of the light passage opening gradually has a smaller area from an outer surface toward an inner surface of the reflecting mirror, the inner surface facing the light emitting section. Namely, the light passage opening is narrower from the outer surface toward the inner surface of the reflecting mirror.

Meanwhile, when seen from the light emitting section side, the optical functional member gradually has a smaller area from the outer surface toward the inner surface of the reflecting mirror. Namely, the optical functional member is also narrower from the outer surface toward the inner surface of the reflecting mirror.

Namely, the optical functional member does not slip through the light passage opening while being embedded in the light passage opening.

This prevents the optical functional member from falling from the light passage opening into the reflecting mirror toward the light emitting section. Further, it is unnecessary to provide the optical functional member by, for example, fixing the optical functional member to the light passage opening (e.g., adhering the optical functional member to the light passage opening by use of an adhesive). This facilitates replacement of the optical functional member. In addition, it is unnecessary to cause the optical functional member to have a complicated shape. This facilitates preparation of the optical functional member.

It is preferable that the light emitting section be located with respect to the light passage opening so that the fluorescence generated by the light emitting section can be considered to enter the aperture plane of the light passage opening at a constant angle, the aperture plane facing the light emitting section.

According to the arrangement, the fluorescence generated by the light emitting section and going toward the light passage opening can enter the light passage opening at a constant angle. This means that the fluorescence entering the optical functional member travels constant distances (propagation distances) in the respective plurality of films of the layer stack.

Therefore, the layer stack of the optical functional member can reflect substantially all the fluorescence going toward the light passage opening.

It is preferable that the excitation light be laser light.

The arrangement reduces the light source in size, so that a smaller light emitting apparatus can be made.

Note that a vehicle headlamp and an illuminating apparatus each including a light emitting apparatus mentioned above, and a vehicle including the vehicle headlamp are encompassed in the technical scope of the present invention.

A method in accordance with the present embodiments for assembling a light emitting apparatus, the light emitting apparatus including: an excitation light source which emits excitation light; a light emitting section which generates fluorescence in response to the excitation light emitted from the excitation light source; a reflecting mirror which reflects the fluorescence generated by the light emitting section; and an optical functional member which transmits the excitation light and reflects the fluorescence, the excitation light source being provided outside the reflecting mirror, the reflecting mirror being provided with a light passage opening through which the excitation light passes, and the optical functional member being provided so as to cover the light passage opening, the method comprising the step of: positioning the excitation light source so that the excitation light passes through a center of the light passage opening.

For example, the excitation light source is positioned while the light emitting apparatus is being assembled. During the positioning, an emission angle at which the excitation light source emits the excitation light with respect to the light passage opening is determined so that the excitation light emitted from the excitation light source passes through the light passage opening without fail.

However, the emission angle of the excitation light source may deviate as time passes. When the deviation becomes great, an optical path of the excitation light deviates from the light passage opening, so that the excitation light cannot pass through the light passage opening. Accordingly, it can be said that a larger allowable value for the deviation of the emission angle is preferable.

In view of the circumstances, according to the arrangement, the excitation light source is located with respect to the light passage opening so that the excitation light passes through a center of the light passage opening. In this case, if the emission angle of the excitation light source starts deviating, the optical path of the excitation light starts deviating from the center of the light passage opening. This means that it is possible to maximize a scale of the deviation of the emission angle which scale is necessary for the optical path of the excitation light to deviate from the light passage opening.

Therefore, according to the arrangement, it is possible to maximize an allowable value for the emission angle of the excitation light source.

The present invention is not limited to the description of the embodiments above, but may be altered by a skilled person within the scope of the claims. An embodiment based on a proper combination of technical means disclosed in different embodiments is encompassed in the technical scope of the present invention.

Note that the present invention can also be described as below. Namely, the present invention is a light emitting apparatus including: a semiconductor light emitting diode; a reflecting mirror; a wavelength conversion element (a fluorescent material) provided on an inner surface of the reflecting mirror; and a multilayer filter which transmits excitation light emitted from the semiconductor light emitting diode and reflects fluorescence generated by the wavelength conversion element, the reflecting mirror being provided with an opening, and the multilayer filter being provided at the opening.

It is preferable that the excitation light pass through a center of the opening.

It is preferable to arrange the multilayer filter such that a multilayer film is provided on a substrate and the substrate is located outside the reflecting mirror.

It is preferable that the excitation light be P polarized light and enter the multilayer filter at an angle of a Brewster angle.

It is preferable that there be no difference in level at a boundary between the reflecting mirror and the multilayer filter inside the reflecting mirror.

It is preferable that a stacking direction of the multilayer filter and a straight line defined by the semiconductor light emitting diode and the fluorescent material be parallel to each other.

It is preferable that a main surface of the multilayer filter be at right angles to the stacking direction of the multilayer filter.

It is preferable that a surface of the multilayer filter which surface faces the reflecting mirror be a curved surface.

It is preferable that the curved surface of the multilayer filter be designed so that a curved surface of the opening of the reflecting mirror and the curved surface of the multilayer filter coincide with each other.

It is preferable that the curved surface be formed on the substrate side of the multilayer filter.

It is preferable that the multilayer film be provided so as to be at right angles to the curved surface.

It is preferable that the multilayer filter have a protrusion.

It is preferable that the multilayer filter be structured to have a smaller area toward an inner surface of the reflecting mirror.

INDUSTRIAL APPLICABILITY

The present invention, which is applicable to a light emitting apparatus and an illuminating apparatus, especially to a headlamp for a vehicle, for example, allows an increase in light emitting efficiency of these apparatuses.

REFERENCE SIGNS LIST

11 Laser element (Excitation light source)
13, 41, 61, 71, 113, 123 Multilayer filter (Light transmitting member)
13*a*, 41*a*, 61*a*, 71*a*, 113*a*, 123*a* Supporting substrate
13*b*, 41*b*, 61*b*, 71*b*, 113*b*, 123*b* Multilayer film (Layer stack)
14 Light emitting section
15, 45, 65, 85, 115, 125 Parabolic mirror (Reflecting mirror)
16, 46, 66, 86, 116, 126 Window part (Light passage opening)
18 Excitation light (Laser light)
19 Fluorescence
101, 102, 103, 104, 105, 125 Headlamp (Light emitting apparatus, Vehicle headlamp)
P21 Tip
P22 Base

The invention claimed is:

1. A light emitting apparatus comprising:
an excitation light source which emits excitation light;
a light emitting section which generates fluorescence in response to the excitation light emitted from the excitation light source;
a reflecting mirror which reflects the fluorescence generated by the light emitting section to form illumination light which travels in a given solid angle; and
an optical functional member which transmits the excitation light and reflects the fluorescence,
the excitation light source being provided outside the reflecting mirror,
the reflecting mirror being provided with a light passage opening through which the excitation light passes,
the optical functional member being provided so as to cover the light passage opening, and
the optical functional member being embedded in the light passage opening so that a surface of the optical functional member faces the light emitting section and that the surface of the optical functional member and a reflecting surface of the reflecting mirror are continuous.

2. The light emitting apparatus as set forth in claim 1, wherein the excitation light source is located with respect to the light passage opening so that the excitation light passes through a center of the light passage opening.

3. The light emitting apparatus as set forth in claim 1, wherein the light emitting section is located with respect to the light passage opening so as to be irradiated with the excitation light even in a case where the excitation light emitted from the excitation light source passes through any place in the light passage opening.

4. The light emitting apparatus as set forth in claim 3, wherein the light emitting section is located with respect to the light passage opening so that the fluorescence generated by the light emitting section can be considered to enter the aperture plane of the light passage opening at a constant angle, the aperture plane facing the light emitting section.

5. The light emitting apparatus as set forth in claim 1, wherein:
the optical functional member has a supporting substrate and a layer stack, the layer stack being provided on an upper part of the supporting substrate and having a multilayer structure of a plurality of films; and
the layer stack transmits light including the excitation light and having a wavelength falling within a first range and reflects light including the fluorescence and having a wavelength falling within a second range.

6. The light emitting apparatus as set forth in claim 5, wherein the layer stack side of the optical functional member faces the light emitting section.

7. The light emitting apparatus as set forth in claim 5, wherein the optical functional member is provided so that a stacking direction of the layer stack in which direction the plurality of films are stacked and an optical path direction of the fluorescence coincide with each other.

8. The light emitting apparatus as set forth in claim 5, wherein the optical functional member is provided so that the stacking direction in which the plurality of films are stacked is at right angles to a surface of the supporting substrate which surface is opposite from a surface of the supporting substrate on which surface the layer stack is provided.

9. The light emitting apparatus as set forth in claim 1, wherein the excitation light is P polarized light with respect to the optical functional member and enters the optical functional member at an angle of a Brewster angle.

10. The light emitting apparatus as set forth in claim 1, wherein the surface of the optical functional member, which faces the light emitting section, is a recessed curved surface.

11. The light emitting apparatus as set forth in claim 10, wherein:
the recessed curved surface and the reflecting surface of the reflecting mirror have identical curvatures; and
the recessed curved surface and the reflecting surface of the reflecting mirror are combined to form a single reflecting surface with respect to the fluorescence when seen from the light emitting section side.

12. The light emitting apparatus as set forth in claim 1, wherein:
the optical functional member has a tip and a base,
the tip being embedded in the light passage opening, and
the base being located outside the reflecting mirror, and having a larger area than an aperture plane of the light passage opening when seen from the light emitting section side.

13. The light emitting apparatus as set forth in claim 1, wherein:

when seen from the light emitting section side, the aperture plane of the light passage opening has a smaller area from an outer surface toward an inner surface of the reflecting mirror, the inner surface facing the light emitting section; and when seen from the light emitting section side, the optical functional member has a smaller area from the outer surface toward the inner surface of the reflecting mirror so that the optical functional member is embedded in the light passage opening.

14. The light emitting apparatus as set forth in claim 1, wherein the excitation light is laser light.

15. A vehicle headlamp comprising a light emitting apparatus recited in claim 1.

16. A vehicle comprising a vehicle headlamp recited in claim 15.

17. An illuminating apparatus comprising a light emitting apparatus recited in claim 1.

18. A method for assembling a light emitting apparatus, the light emitting apparatus including an excitation light source which emits excitation light, a light emitting section which generates fluorescence in response to the excitation light emitted from the excitation light source, a reflecting mirror which reflects the fluorescence generated by the light emitting section, and an optical functional member which transmits the excitation light and reflects the fluorescence, the excitation light source being provided outside the reflecting mirror, the reflecting mirror being provided with a light passage opening through which the excitation light passes, and the optical functional member being provided so as to cover the light passage opening, said method comprising the step of:

positioning the excitation light source so that the excitation light passes through a center of the light passage opening;

configuring the reflecting mirror so as to reflect the fluorescence generated by the light emitting section to form illumination light which travels in a given solid angle; and embedding the optical functional member in the light passage opening so that a surface of the optical functional member faces the light emitting section and that the surface of the optical functional member and a reflecting surface of the reflecting mirror are continuous.

* * * * *